United States Patent [19]

Wochnowski et al.

[11] 4,452,256

[45] * Jun. 5, 1984

[54] METHOD AND APPARATUS FOR CONDITIONING TOBACCO

[75] Inventors: Waldemar Wochnowski; Reinhard Hohm, both of Hamburg, Fed. Rep. of Germany

[73] Assignee: Hauni-Werke Körber & Co. KG., Hamburg, Fed. Rep. of Germany

[ * ] Notice: The portion of the term of this patent subsequent to Aug. 31, 1999 has been disclaimed.

[21] Appl. No.: 324,127

[22] Filed: Nov. 23, 1981

Related U.S. Application Data

[60] Division of Ser. No. 037,995, May 9, 1979, Pat. No. 4,346,524, which is a continuation-in-part of Ser. No. 922,575, Jul. 6, 1978, Pat. No. 4,241,515, which is a continuation of Ser. No. 448,949, Mar. 7, 1974, Pat. No. 4,143,471, which is a continuation-in-part of Ser. No. 220,599, Jan. 25, 1972, Pat. No. 3,799,176.

[30] Foreign Application Priority Data

| | | | |
|---|---|---|---|
| Jan. 27, 1971 | [DE] | Fed. Rep. of Germany | 2103671 |
| Jun. 29, 1971 | [DE] | Fed. Rep. of Germany | 2132226 |
| Jul. 14, 1973 | [DE] | Fed. Rep. of Germany | 2335970 |

[51] Int. Cl.[3] ..... A24B 3/12

[52] U.S. Cl. ..... 131/303; 131/304

[58] Field of Search ..... 131/304, 303; 34/26, 34/46

[56] References Cited

U.S. PATENT DOCUMENTS

| | | | |
|---|---|---|---|
| 3,799,176 | 3/1974 | Wohnowski et al. | 131/304 |
| 4,346,524 | 8/1982 | Wochnowski et al. | 131/304 |

*Primary Examiner*—Vincent Millin

*Attorney, Agent, or Firm*—Peter K. Kontler

[57] ABSTRACT

A continuous stream of moist tobacco particles is withdrawn from a magazine by a carded belt conveyor, and successive increments of the stream are weighed prior to transport past a measuring unit which ascertains the initial moisture content of successive increments of the stream. The signals which are generated by the weighing device are used to regulate the speed of the carded conveyor so as to insure that each unit length of the stream reaching the measuring unit contains identical quantities of tobacco particles per weight. The stream is thereupon transported through a moisture increasing unit wherein the stream is traversed by ascending currents of steam and wherein one or more nozzles sprinkle metered quantities of water onto successive increments of the stream. The moisture content of tobacco particles leaving the moisture increasing unit is substantially constant, and such particles thereupon enter a drying unit which includes a rotary drum-shaped conveyor wherein the particles are dried by hot air streams which flow concurrent with and counter to the direction of tobacco transport through the conveyor as well as by steam-heated coils which are installed in the interior of the conveyor to directly heat the conveyor and to directly heat the tobacco particles therein. The final moisture content of tobacco particles is measured downstream of the drying conveyor and the rate of flow of hot air which flows countercurrent to the tobacco stream and/or the rate of circulation of steam in the coils is regulated in dependency on deviations of the final moisture content from a preselected optimum value.

12 Claims, 8 Drawing Figures

METHOD AND APPARATUS FOR CONDITIONING TOBACCO

CROSS-REFERENCE TO RELATED APPLICATIONS AND PATENTS

This is a division of our copending application Ser. No. 037,995 filed May 9, 1979, now U.S. Pat. No. 4,346,524 granted Aug. 31, 1982, which is a continuation-in-part of our copending application Ser. No. 922,575 filed July 6, 1978, now U.S. Pat. No. 4,241,515 granted Dec. 30, 1980. The application Ser. No. 922,575 is a continuation of Ser. No. 448,949 filed Mar. 7, 1974, now U.S. Pat. No. 4,143,471 granted Mar. 13, 1979. The application Ser. No. 448,949 is a continuation-in-part of Ser. No. 220,599 filed Jan. 25, 1972, now U.S. Pat. No. 3,799,176 granted Mar. 26, 1974.

BACKGROUND OF THE INVENTION

The present invention relates to a method and apparatus for conditioning tobacco. More particularly, the invention relates to improvements in a method and apparatus for drying particles of tobacco which are transported in the form of a continuous stream.

Tobacco driers are becoming increasingly important components of primary tobacco processing equipment. This is due to the fact that the manufacturers of cigarettes or other smokers' products demand an extremely accurate conditioning of tobacco prior to admission into a cigarette maker or a like machine. The final moisture content of conditioned tobacco particles must match a preselected optimum value, and each and every portion of each tobacco particle must or should be dried to the same extent. Such high degree of homogeneousness (as regards the final moisture content of conditioned tobacco) cannot be achieved in accordance with heretofore known methods and by resorting to heretofore known primary tobacco processing equipment. One of the reasons for inability of conventional primary processing equipment to meet the aforediscussed stringent requirements regarding the final moisture content of each and every portion of each particle of conditioned tobacco is that the conditioning invariably involves treatment of large quantities of tobacco particles per unit of time. The initial moisture content of tobacco which is admitted into the first unit of a primary processing equipment invariably fluctuates above and below an anticipated (predetermined) value. Therefore, the drying action upon successive increments of a tobacco stream which is conveyed through the conditioning zone or zones must fluctuate in order to achieve a more pronounced drying action when the initial moisture content is relatively high and to reduce the intensity of drying action when the initial moisture content of tobacco particles entering the first stage of primary processing equipment is relatively low.

Heretofore known attempts to insure that the final moisture content of conditioned tobacco particles will match a preselected optimum value include the provision of highly complex, expensive and sensitive control systems which detect fluctuations of the initial moisture content and regulate the drying action in dependency on deviations of initial moisture content from an anticipated (predetermined) value. It was also proposed to subject tobacco particles which leave the drying unit to a secondary conditioning action, for example, in a manner as disclosed in commonly owned U.S. Pat. No. 4,143,471 granted Mar. 13, 1979. Such secondary conditioning normally insures that the moisture content of tobacco particles which leave the secondary conditioning equipment matches or closely approximates a preselected value. However, secondary conditioning is less effective if the condition of tobacco particles which enter the primary conditioning zone is not uniform; under such circumstances, the drying action is likely to be less satisfactory than in the absence of secondary conditioning equipment.

OBJECTS AND SUMMARY OF THE INVENTION

An object of the invention is to provide a novel and improved method of conditioning a stream of tobacco particles wherein the initial moisture content of tobacco particles fluctuates or is likely to fluctuate within a certain (narrow or relatively wide) range.

Another object of the invention is to provide a method which insures uniform drying of all tobacco particles of a continuous stream without resorting to a secondary treatment after the particles issued from the drying unit.

A further object of the invention is to provide a method which insures uniform drying of each and every portion of each tobacco particle in a continuous stream during a single pass of such particles through a drying unit.

An additional object of the invention is to provide a method which insures that the final or ultimate moisture content of tobacco particles is uniform and matches a preselected value regardless of the condition of particles which enter the first stage of the conditioning apparatus.

Another object of the invention is to provide a method according to which the particles of tobacco are treated gently and which insures uniform drying of large quantities of tobacco particles per unit of time.

A further object of the invention is to provide a method which insures highly satisfactory drying of a continuous stream of tobacco particles in a small area, even if the initial moisture content of such particles fluctuates within an extremely wide range.

An additional object of the invention is to provide a novel and improved conditioning apparatus for the practice of the above outlined method.

Another object of the invention is to provide an apparatus wherein a single drying unit suffices to complete the expulsion of surplus moisture from all particles of a continuous tobacco stream even if the initial moisture content of the particles in randomly distributed portions of the stream is well above or well below an anticipated predetermined value.

A further object of the invention is to provide a novel and improved drying unit for use in an apparatus of the above outlined character.

An ancillary object of the invention is to provide novel and improved means for increasing the moisture content of tobacco particles prior to admission of the respective portions of a continuous tobacco stream into the drying unit.

A further object of the invention is to provide the apparatus with relatively simple but highly reliable and effective controls for the drying and moisture increasing units.

Another object of the invention is to provide the apparatus with novel and improved means for transporting a continuous stream of tobacco particles through various units including the aforementioned moisture increasing and drying units.

An ancillary object of the invention is to provide an apparatus which can condition large quantities of tobacco particles per unit of time in a small area and with a heretofore unmatched degree of predictability.

One feature of the invention resides in the provision of a method of conditioning tobacco. The method comprises the steps of transporting a continuous stream of tobacco particles at a constant rate along a predetermined path, measuring the initial moisture content of successive increments of the stream in a first portion of the path, increasing the moisture content of tobacco particles in a second portion of the path when the measured initial moisture content is below a predetermined value, and drying the particles of the stream in a third portion of the path. The step of increasing the moisture content of tobacco particles preferably takes place simultaneously with heating of the particles during transport along the respective (second) portion of the path. The drying step preferably comprises subjecting the particles of tobacco to an adjustable heating action, and the method preferably further comprises the steps of measuring the final moisture content of successive increments of the stream of dried tobacco particles in a fourth portion of the path and adjusting the heating action in the third portion of the path when the measured final moisture content deviates from a preselected moisture content. The step of increasing the moisture content preferably takes place simultaneously with the additional step of agitating the particles of tobacco in the second portion of the path. This, combined with heating of tobacco particles during moisturizing, insures a more uniform wetting of each particle and of each portion of each particle. The heating step in the second portion of the path may include conveying a hot fluid (such as steam) transversely across the stream, e.g., by discharging streamlets of steam from a manifold and through an apertured bottom wall of a conveyor which transports the particles in the second portion of the path.

The step of increasing the moisture content of tobacco particles in the second portion of the path preferably comprises contacting the particles of tobacco with droplets of a liquid medium (e.g., water). Some moisturizing action is achieved as a result of contact between the particles of tobacco and the aforementioned streamlets of steam. The liquid medium is preferably sprayed onto successive increments of the tobacco stream in the second portion of the path. The quantity of liquid which contacts the particles of tobacco in the course of the step of increasing the moisture content can be varied as a function of the extent of deviation of the measured initial moisture content from the aforementioned predetermined value.

The drying step may comprise conveying a first current of a hot gaseous fluid (e.g., air) through the third portion of the path concurrent with the direction of transport of tobacco particles and conveying a second current of hot gaseous fluid counter to the direction of tobacco transport along the third portion of the path. For example, the second current can be conveyed across the tobacco stream in the region where the particles of tobacco leave the third portion of the path. The just discussed drying step may further include establishing a third current of hot gaseous fluid (such third current can issue from the outlet of a blower which draws hot fluid from a suction pipe wherein heated atmospheric air is mixed—when necessary—with cool atmospheric air), maintaining the temperature of the third current at a constant value, and dividing the third current into the aforementioned first and second currents.

The drying step may further include establishing a further current which is thereupon divided into the aforementioned second current and an additional current. If the method further comprises the step of measuring the final moisture content of dried tobacco particles in the aforementioned fourth portion of the path, the ratio of fluids in the second and additional currents can be varied when the measured final moisture content deviates from the preselected value. The first, second and additional currents are preferably merged in the region where successive increments of the stream leave the third portion of the path, and the thus merged currents are conveyed from such region along a further path, e.g., through a pipe which evacuates spent fluid from a withdrawing device at the outlet of a rotary drum-shaped conveyor which defines the third portion of the path. The drying step preferably further comprises varying the quantity of hot fluid which forms the second current when the final moisture content deviates from the preselected value; such varying step may include reducing the quanitity of fluid in the second current and simultaneously increasing the quantity of fluid in the additional current when the final moisture content of tobacco particles is too low and vice versa. The particles of tobacco in the third portion of the path can be heated by hot fluid which forms the first and second currents as well as by a second fluid which heats the aforementioned rotary conveyor and indirectly heats the particles of tobacco in the rotary conveyor (e.g., by circulating the second fluid through coils which are disposed in the interior of and rotate with the conveyor so that the particles of tobacco in the third portion of the path contact the conveyor as well as the coils). The quantity of second fluid can be varied as a function of variations of the quantity of fluid forming the second current. The drying action can be enhanced by agitating the particles of tobacco in the third portion of the path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
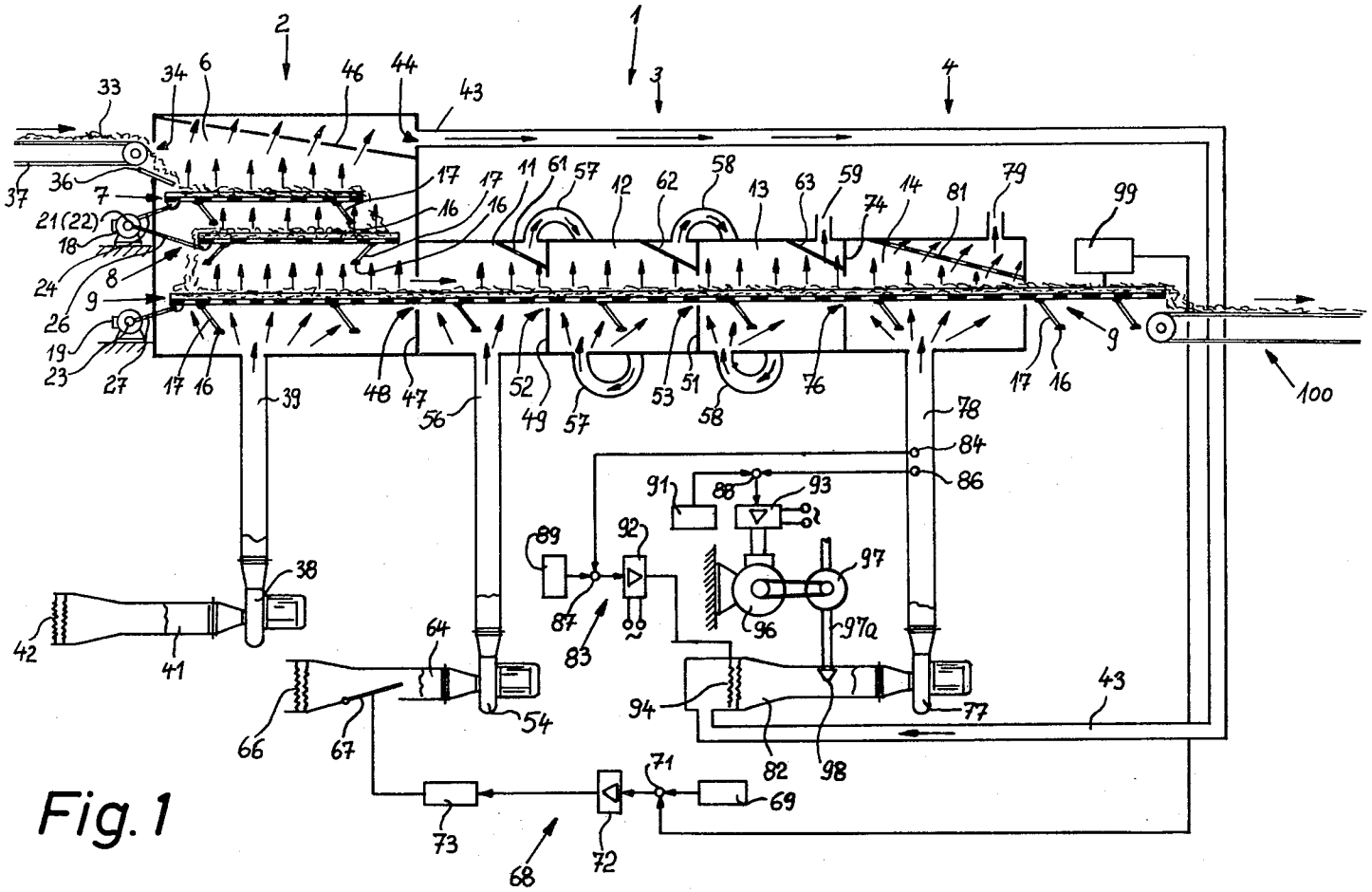
FIG. 1 is a schematic partly elevational and partly sectional view of a first conditioning apparatus.

The conditioning apparatus of FIG. 1 comprises a tobacco transporting system 1 including a first or foremost section 2, a second or intermediate section 3, and a third or rear section 4. The first transporting section 2 comprises a chamber 6 for three discrete vibratory conveyors 7, 8 and 9 which are disposed at different levels, with the conveyor 8 located above the conveyor 9 but below the conveyor 7. The right-hand or discharge end of the uppermost conveyor 7 discharges successive increments of a continuous stream of tobacco particles 33 onto the right-hand end of the median conveyor 8, and the left-hand end of the median conveyor 8 discharges successive increments of the tobacco stream onto the left-hand end of the lowermost conveyor 9. The latter is substantially longer than the conveyors 7, 8 and extends through and beyond successive chambers 11, 12, 13 of the intermediate transporting section 3 as well as through and beyond the single chamber 14 of the rear transporting section 4. The conveyors 7, 8 and 9 are mounted on sets of carriers or supports 16 by means of pairs of leaf springs 17 (see also FIG. 2). The drive means for vibrating the conveyors 7, 8 comprises an electric motor 18 whose output shaft rotates two eccentrics 21, 22 which are respectively coupled with the conveyors 7, 8 by connecting rods 24, 26. The drive means for vibrating the conveyor 9 comprises a second electric motor 19 whose output shaft drives an eccentric 23 for a third connecting rod 27.

Figure 2:
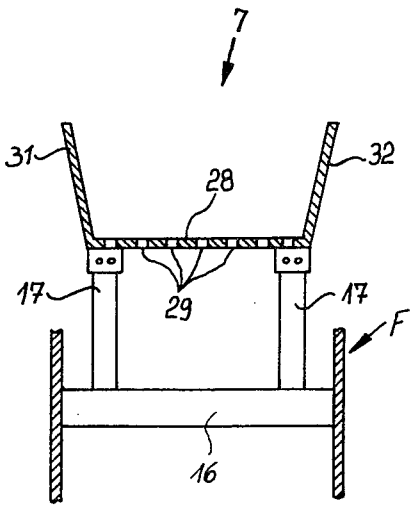
FIG. 2 is an enlarged transverse vertical sectional view of a conveyor in the apparatus of FIG. 1.

FIG. 2 shows that the carriers 16 are mounted in the frame F of the conditioning apparatus and that the conveyor 7 comprises a foraminous bottom wall or platform 28 having perforations or holes 29, and two side walls 31, 32 which flank the platform 28 and diverge upwardly and outwardly so that the width of the channel which is defined by the conveyor 7 increases in a direction upwardly and away from the bottom wall 28. The construction of the other two conveyors 8, 9, is identical with that of the conveyor 7.

Referring again to FIG. 1, the upper end portion of the left-hand wall of the chamber 6 has an inlet opening 34 at a level above the left-hand end of the uppermost vibratory conveyor 7. The particles 33 descend onto the conveyor 7 by sliding along an inclined chute 36 which receives tobacco from the upper stretch of a continuously driven conveyor belt 37.

The conditioning apparatus further comprises a first conditioning device having means 41, 38, 39 for circulating through the tobacco particles 33 in the chamber 6 a current of heated air counter to the direction of tobacoo travel. The circulating means comprises a blower 38 which is connected with the lower portion of the chamber 6 by a pipe 39 and receives heated air by way of a suction pipe 41 containing a preferably adjustable electric resistance heater 42 which constitutes a means for maintaining a characteristic (the temperature) of the first current within a predetermined range. The inflowing air is heated by the heater 42 and passes through the pipe 41, blower 38 and pipe 39 to enter the chamber 6 below the left-hand portion of the vibratory conveyor 9. The current of hot air passes upwardly through the perforations 29 in the bottom wall 28 of the conveyor 9, thereupon through the median conveyor 8 and finally through the uppermost conveyor 7 to be evacuated by way of an outlet opening 44 located behind a sieve or filter 46 which serves as a means for intercepting those tobacco particles 33 which might be entrained by the ascending air currents. The outlet opening 44 admits air into an elongated pipe or conduit 43. The current of air entering the chamber 6 by way of the pipe 39 is subdivided into a large number of smaller currents during travel through the bottom walls 28 of the conveyors 7, 8 and 9.

The chamber 6 of the first transporting section 2 is separated from the first chamber 11 of the second transporting section 3 by a partition or wall 47 having an opening 48 for the conveyor 9. Similar partitions or walls 49, 51, 74 respectively separate the chambers 11–12, 12–13 and 13–14; these partitions are respectively provided with openings 52, 53 and 76 for the conveyor 9. A further opening in the right-hand wall of the chamber 14 in the transporting section 4 serves to permit passage of the conveyor 9 and of the stream of conditioned tobacco particles thereon.

In the transporting section 2, tobacco particles 33 are treated by a second current of hot air which flows concurrent with the tobacco stream, i.e., through the chambers 11, 12 and 13 in that order. Such second current is induced by a second blower 54 which is connected with the lower portion of the chamber 11 by a pipe 56 and is further connected with a suction pipe 64 serving to draw atmospheric air past a preferably adjustable electric resistance heater 66. The suction pipe 64 further contains an adjustable regulating valve 67 here shown as a flap which is pivotable by a servomotor 73 and serves to regulate the temperature of air which enters the pipe 56 and chamber 11 by determining the rate at which air flowing across the heater 66 is mixed with unheated atmospheric air in the pipe 64. The upper portion of the chamber 11 (above the conveyor 9) is connected with the lower portion of the chamber 12 (below the conveyor 9) by means of a suitably bent conduit or pipe 57, and a similar conduit or pipe 58 connects the upper portion of the chamber 12 with the lower portion of the chamber 13. Sieves or filters 61, 62 are respectively mounted in the chambers 11, 12 below the intake ends of the conduits 57, 58 to prevent the escape of tobacco particles. The upper portion of the chamber 13 is provided with an outlet opening 59, located behind a sieve or filter 63, to permit the escape of spent air into the surrounding atmosphere.

The aforementioned servomotor 73 forms part of a control unit 68 which determines the position of the regulating valve 67 in the suction pipe 64. This control unit 68 further comprises a potentiometer 69 or another suitable source of reference signals which is connected with a signal comparing stage 71. The output signal from the stage 71 is amplified at 72 and is transmitted to the servomotor 73 to be used as a means for determining the setting of the regulating valve 67. It will be seen that the second conditioning device which causes the second air current to flow through the section 3 comprises means 66, 64, 56, 54, 57, 58 for circulating the second current concurrent with the direction of tobacco transport and means 67, 68, 73 for maintaining the temperature of the second current within a predetermined range.

A third conditioning device of the apparatus comprises means 82, 77, 78 for circulating a current of moist heated air across the tobacco stream on the conveyor 9 in the chamber 14 of the third transporting section 4. Such circulating means comprises a blower 77 which is connected with the lower portion of the chamber 14 by a pipe 78. The suction pipe 82 of the blower 77 is connected with the outlet opening 44 of the chamber 6 by means of the aforementioned conduit 43, and the thus admitted air can be heated in the suction pipe 82 by an electric resistance heater 94 which is adjustable by a control unit 83. The latter insures that the characteristics of the air current which enters the pipe 78 and chamber 14 do not change at all or fluctuate within a very narrow range. The control unit 83 comprises two detectors 84, 86 which are mounted in the pipe 78 and respectively serve to measure the temperature and moisture content of the air current flowing into the lower portion of the chamber 14 below the conveyor 9. The detector 84 may be any suitable thermoelement or heat-sensitive conductor (NTC or PTC) which can generate signals indicating the temperature of surrounding air, and the detector 86 may be a conventional hygrometer. The control unit 83 further comprises two signal comparing stages 87, 88, two potentiometers 89, 91 or analogous sources of reference signals, and two output amplifiers 92, 93. Still further, the control unit 83 comprises a variable-speed electric motor 96 which receives signals from the amplifier 93 and drives a variable-delivery pump 97 in a water line **97*a* having an atomizing nozzle 98 mounted in the suction pipe 82 downstream of the heater 94. The source from which the line 97*a* draws water at the rate determined by the speed of the motor 96 is not shown in FIG. 1**.

The fully conditioned tobacco particles 33 on that portion of the conveyor 9 which extends beyond the chamber 14 of the last transporting section 4 travel past a detector 99 which serves to monitor and determine the moisture content of tobacco particles downstream of the chamber 14. The detector 99 may be of the type known as HWK produced by the assignee of the present application. The signal which is generated by the detector 99 is indicative of the moisture content of conditioned tobacco and is transmitted to the stage 71 of the control unit 68 to be compared with the signal which is furnished by the potentiometer 69. The detector 99, potentiometer 89, junction 71, amplifier 72 and servomotor 73 together form a circuit which determines the moisture content of conditioned tobacco in that the signal furnished by the detector 99 serves to cause the servomotor 73 to adjust the regulating valve 67 when the intensity of the signal from the detector 99 deviates from that of the signal furnished by the potentiometer 69, i.e., when the moisture content of tobacco downstream of the chamber 14 deviates from a desired predetermined moisture content as represented by the signal from the potentiometer 69.

A take-off conveyor 100 (e.g., an endless belt) serves to transport conditioned tobacco to a further processing station, not shown.

The operation:

The conveyor belt 37 delivers a continuous stream of tobacco particles 33 onto the chute 36 which, in turn, delivers such particles into the channel between the walls 28, 31, 32 of the uppermost vibratory conveyor 7 in the chamber 6 of the first transporting section 2. The conveyor 7 transports the tobacco stream lengthwise in a direction to the right, and the stream thereupon reverses the direction of its movement during transport on the median conveyor 8 to again move in a direction to the right while moving between the walls 28, 31, 32 of the conveyor 9. The latter transports the tobacco stream through the opening 48 in the partition 47 and into and through successive chambers 11, 12 and 13 of the median transporting section 3.

The blower 38 delivers into the pipe 39 a continuous current of hot air whereby such air flows upwardly through the perforations 29 in the bottom wall 28 of the conveyor 9, thereupon through the bottom wall 28 of the conveyor 8 to pass finally through the bottom wall 28 of the conveyor 7 toward and through the interstices of the sieve 46 and to leave the chamber 6 by way of the outlet opening 44 prior to entering the conduit 43 on its way into the inlet of the suction pipe 82. As the current of air passes through the bottom walls 28 of the three conveyors 7, 8 and 9, the resulting smaller currents of hot air agitate tobacco particles 33 on the respective conveyors to bring about a thorough heating action. It will be noted that the flow of hot air in the chamber 6 is counter to the direction of transport of tobacco particles 33 because the hot air first impinges on tobacco which is transported by the lowermost conveyor 9, i.e., by the conveyor which is remotest from the inlet opening 34, thereupon on tobacco which is being transported by the median conveyor 8, and finally on tobacco which is transported by the uppermost conveyor 7. Actually, the flow of hot air takes place at right angles to the direction of transport of tobacco particles 33, but only when considered in a relatively small portion of each of the three troughs formed by the walls 28, 31 and 32 of the respective vibratory conveyors.

The connecting rods 24, 26 and 27 transmit to the walls 28, 31, 32 of the respective conveyors 7, 8 and 9 recurrent movements which cause the particles of tobacco to "bounce" on the respective bottom walls 28. Such bouncing or rebounding of particles 33 is further assisted by small currents of hot air which flow upwardly through the perforations 29 whereby the particles in the channels of the three vibratory conveyors 7–9 form three layers of highly agitated tobacco. Such mode of transport and treatment is highly desirable because the entire external surface of each tobacco particle is repeatedly brought into contact with surrounding hot air to thereby insure a highly effective exchange of energy between tobacco and hot air.

Since the side walls 31, 32 of the conveyors 7–9 diverge upwardly, i.e., in the direction of flow of currents of hot air across the tobacco stream, the speed of such air currents decreases in the same direction which is desirable because the decelerated air currents are less likely to entrain lighter tobacco particles toward the sieve 46. Countercurrent flow of hor air in the chamber 6 is desirable because the particles 33 which enter the chamber 6 by way of the inlet opening 34 are not immediately subjected to the action of very hot air. On the contrary, very hot air first comes into contact with particles 33 on the conveyor 9, i.e., with particles which were preheated by hot air at less than maximum temperature on the conveyor 8 and with even less hot air on the conveyor 7. This reduces the likelihood of the formation of hard crusts along the external surfaces of tobacco particles in the transporting section 2.

The temperature of air currents passing through the interstices of the sieve 46 and into the conduit 43 is normally substantially less then the temperature of air in the pipe 39, and the air in the conduit 43 is enriched with moisture which is being withdrawn from tobacco particles 33 on the conveyors 7–9. The conveyor 9 transports the pretreated tobacco particles 33 from the chamber 6, through the opening 48 in the partition 47 and into the first chamber 11 of the second transporting section 3, thereupon into the second chamber 12, into the third chamber 13 and finally into and through the chamber 14 of the third transporting section 4. During travel across the chamber 11, the particles 33 are agitated by the bottom wall 28 of the conveyor 9 as well as by small currents of hot air which is supplied by the blower 54 via pipe 56 and flows through the perforations 29 toward and through the interstices of the sieve 61 to enter the conduit 57 on its way into the lower portion of chamber 12. The small currents of air which pass through the perforations 29 of the bottom wall 28 in the chamber 12 thereupon pass through the sieve 62 and conduit 58 to enter the lower portion of the chamber 13, to pass again through the conveyor 9, thereupon through the sieve 63 and to discharge into the atmosphere by way of the outlet opening 59. The flow of air currents across the tobacco stream in the chambers 11–13 takes place substantially at right angles to the direction of transport of tobacco particles; however, since the air current first enters the chamber 11 and thereupon passes across the chambers 12 and 13, the overall flow of such air is concurrent with the direction of tobacco travel through the transporting section 3.

The tobacco stream which passes across the chamber 14 of the transporting section 4 is treated by currents of moist hot air which is delivered by the blower 77 via pipe 78. Such air currents pass through the perforations 29 of the bottom wall 28 in the chamber 14, thereupon through a sieve 81, and are discharged by way of an outlet opening 79. The moisture content of air which is admitted into the chamber 14 via pipe 78 is due to the fact that such air is delivered into the pipe 82 by way of the conduit 43 and also due to the provision of the atomizing nozzle 98 which delivers a spray of water into the pipe 82 downstream of the heater 94 at a rate which is determined by the speed of the electric motor 96. The condition of air which is supplied by the pipe 78 preferably corresponds exactly to the desired condition of tobacco which leaves the chamber 14 on its way toward the take-off conveyor 100, i.e., the moisture content and/or temperature of such air can be selected with a view to match or at least to closely approximate the desired moisture content and/or temperature of conditioned tobacco particles 33. Such treatment of air which enters the chamber 14 insures the establishment of hygroscopic equilibrium between the air in the transporting section 4 and the tobacco particles 33; this is desirable in order to insure that the moisture content is uniform in each portion of each tobacco particle which leaves the chamber 14.

The detector 84 in the pipe 78 generates signals which are indicative of the temperature of air supplied by the blower 77, and such signals are transmitted to the stage 87 to be compared with reference signal which is furnished by the potentiometer 89. The latter is adjusted so that its output signal represents the desired temperature of tobacco particles 33 on the conveyor 9 downstream of the chamber 14. When the temperature of air in the pipe 78 exceeds the desired temperature of conditioned tobacco, the stage 87 transmits a signal to the amplifier 92 which adjusts the heater 94 so that the air current which is supplied by the conduit 43 is subjected to a less intensive heating action. Inversely, when the temperature of air in the pipe 78 is too low, the signal which is furnished to the amplifier 92 is indicative of the difference between the intensities of signals from the detector 84 and potentiometer 89, and the heating action of the heater 94 upon air which is admitted into the pipe 32 by way of the conduit 43 is intensified accordingly.

The detector 86 generates signals which are indicative of the moisture content of air in the pipe 78; such signals are transmitted to the stage 88 which compares them with the reference signal furnished by the potentiometer 91. Depending on the positive or negative sign of the difference between the intensities of signals furnished by the detector 86 and potentiometer 91, the stage 88 transmits to the amplifier 93 signals which cause a deceleration or acceleration of the motor 96 with the result that the pump 97 delivers to the nozzle 98 larger or smaller quantities of water per unit of time. It will be noted that the control unit 83 automatically regulates the condition of air in the pipe 78 to match or to closely approximate at least one desired characteristic of tobacco particles 33 on the conveyor 9 downstream of the chamber 14.

An advantage of the control unit 83 is that it can effect rapid changes in the temperature and/or moisture content of air in the pipe 78 because the suction pipe 82 receives a continuous current of preconditioned air, namely, a current of air which is preheated because it has already passed across the heater 42 and which contains moisture because it has been in contact with tobacco in the chamber 6. Consequently, the condition of air in the pipe 78 can be changed practically without any delay to thus insure that the temperature and/or moisture content of all portions of the tobacco stream which leaves the chamber 14 deviates little from or is identical with an optimum value. Moreover, the energy requirements of the control unit 83 are relatively low because such unit must insure an optimum temperature and moisture content of a preconditioned air current. Still further, the delivery of preheated and humid air from the chamber 6 into the suction pipe 82 reduces the overall air requirements of the apparatus with attendant savings in cost.

After the tobacco stream leaves the chamber 14, its particles 33 move past the detector 99 which generates signals indicating the moisture content of conditioned tobacco. Such signals are transmitted to the stage 71 and are compared with the signal from the potentiometer 69. If the two signals differ in intensity, the stage 71 transmits a signal to the amplifier 72 which causes the servomotor 73 to change the position of the regulating valve 67 and hence the temperature of air in the pipe 56. The detector 99 cooperates with the control unit 68 to effect very accurate changes in the moisture content of tobacco particles 33 by regulating the heating action of air currents in the chambers 11–13 of the intermediate transporting section 3. It will be noted that the detector 99 influences the conditioning action in the intermediate, rather than the last, transporting section of the system 1.

The conveyor 9 delivers conditioned tobacco onto the upper stretch of the take-off conveyor 100 which transports such material to one or more additional treating stations, not shown.

By way of example, the conditioning apparatus of FIGS. 1 and 2 can be designed to process 2,500 kilograms of tobacco per hour. The initial moisture content of tobacco particles 33 (on the belt 37) may be about 19 percent, the overall length of the chamber 6 (as considered in the direction of tobacco transport on the conveyor 7, 8 or 9) may be about 150 centimeters, the overall length of the transporting section 3 may be about 150 centimeters and the length of the transporting section 4 may be about 250 centimeters. The width of the chambers 6 and 11–14 may be about 80 centimeters and the speed at which the currents of air are conveyed through these chambers may be about 110 centimeters per second. The temperature of air which enters the chambers 6 and 11 may be about 180° C. The temperature of air which enters the chamber 14 may be 25° C. and its moisture content may be about 60 percent. The final moisture content of tobacco at the downstream end of the conveyor 11 (below the detector 99) may be 12 percent. It is clear that the above values will vary with changes in the rate of tobacco delivery, with the nature of tobacco, with the desired final moisture content of tobacco and/or other factors. Moreover, the temperature of air currents in the transporting sections 2 and 3 can be reduced if the speed of tobacco transport is reduced or vice versa; the length of the section 2 may differ from the length of the section 3; the number of chambers in the section 3 may be reduced or increased; and the conditioning medium can be a gaseous fluid other than air. Also, the conveyor 7, 8 and/or 9 can be replaced with two or more conveyors and the heater 42, 66 and/or 94 can be replaced with other types of heating devices. For example, at least the transporting sections 2 and 3 may employ tobacco conveyors in the form of open-ended revolving drums or endless foraminous belts. These are but a few examples of various modifications which can be carried out within the purview of the invention.

The method which can be performed by resorting to the apparatus of FIGS. 1 and 2 differs from previously known methods in that the particles 33 of tobacco are subjected to the action of a first current of gaseous fluid which is conveyed countercurrent to the direction of travel of particles in a first portion of the path defined by the transporting system 1 (namely, in the transporting section 2) and whose characteristics (particularly its rate of flow and its temperature) are maintained within a predetermined range (e.g., at or about 110 centimeters per second and 180° C.), and that the particles 33 are thereupon subjected to the action of a second current of a gaseous fluid which is conveyed concurrent with the direction of travel of tobacco particles in a second portion of the path (namely, in the portion defined by the transporting section 3) located downstream of the first portion and whose characteristics (particularly its rate of flow and its temperature) are also maintained within a predetermined range (e.g., at or about 100 centimeters per second and 180° C.). Furthermore, the particles 33 are subjected to the action of a third current of a gaseous fluid in a third portion of the path located downstream of the second portion (namely, in the portion defined by the transporting section 4) and the characteristics of the third current (particularly its temperature and moisture content) are maintained within a predetermined range (e.g., at or about 25° C. and at or about 60 percent).

The conditioning in the second transporting section 3, which follows the conditioning in the transporting section 2, exhibits the advantage that tobacco particles 33 leaving the chamber 13 can be brought into hygroscopic equilibrium with the gaseous fluid which contacts the particles 33 in the section 4. In certain instances, it suffices to condition the tobacco particles with only two currents of a gaseous fluid, namely, in the sections 2 and 3 of the transporting system 1. However, such procedure cannot always insure practically instantaneous correction for eventual deviations of final moisture content from a desired or preselected moisture content. In other words, were the chamber 14 omitted, it would require a longer interval of time to change the moisture content of tobacco particles 33 which leave the chamber 13 if the moisture content of such particles would be higher or less than the desired moisture content. The provision of the transporting section 4 and of the conditioning means for gaseous fluid which is supplied into the chamber 4 via pipe 78 renders it possible to reduce the length of intervals which are needed to eliminate eventual deviations of final moisture content from a desired moisture content. This is achieved by selecting at least one characteristic of the gaseous fluid which enters the chamber 14 in such a way that it matches or closely approaches the desired corresponding characteristic of the particles 33 on the conveyor 100.

The provision of the conduit 43 reduces the energy requirements of the apparatus because this conduit conveys the once-used gaseous fluid from a preceding transporting section (2) into a next-following transporting section (4). It is clear that, if necessary, the chamber 14 can receive at least some air which leaves the chamber 6 and/or at least some air which leaves the chamber 13. Fluctuations in the moisture content of tobacco which leaves the chamber 14 are reduced due to the provision of the detector 99 which influences the characteristics of at least one of the three currents of gaseous fluid; in the embodiment of FIGS. 1 and 2, the detector 99 influences the temperature of air which is admitted into the chamber 11 of the transporting section 3. The vibratory conveyors 7–9 insure an optimum exchange of energy between tobacco particles 33 and the air currents by agitating the particles during transport through the chambers 6 and 11-14 to thus insure that each air current can intimately contact all sides of each particle.

It has been found that the air currents which pass through the conveyors 9, 8 and 7 in the chamber 6 effect a highly desirable homogenization of tobacco which enters the section 3. This is due to the fact that air currents passing through the conveyor 9 are enriched with moisture by contact with tobacco particles on the conveyor 9 and thereupon by contact with tobacco particles on the conveyor 8 to such an extent that air which contacts the particles on the conveyor 7 is in a state of substantial or virtual hygroscopic equilibrium with tobacco supplied by the chute 36. Thus, air currents ascending through the holes in the bottom wall of the foraminous conveyor 7 eliminate eventual fluctuations in the moisture content of tobacco particles entering the chamber 6 via inlet opening 34 so that the moisture content of tobacco entering the first chamber 11 of the section 3 is at least substantially uniform. This contributes significantly to uniformity of the drying action in the chambers 11, 12 and 13, and renders it possible to reduce the dimensions of the section 4 and/or 3 since the currents of air entering the sections 3 and 4 treat a homogeneous or substantially homogeneous material.

The section 2 can be said to constitute that portion of the apparatus wherein the product is homogenized prior to expulsion of the major part of surplus moisture while insuring that the particles of tobacco retain their desirable mechanical properties, such as suppleness or flexibility and resistance to breakage during transport in the form of a stream which floats in the troughs of the conveyors 7, 8 and 9. This is attributable to the establishment of substantial or exact hygroscopic equilibrium between the major part of tobacco and air current, either in the conveyor 8 but not later than in the conveyor 7, whereby such equilibrium insures that the moisture content of tobacco in the conveyor 8 and/or 7 changes only in those portions of the tobacco stream whose moisture content deviates from the moisture content of the bulk of tobacco entering the chamber 6 via inlet opening 34. Consequently, hot air which enters the chambers of the section 3 can expel moisture from a homogeneous tobacco stream which contributes significantly to a more uniform and reproducible drying action.

Figure 3:
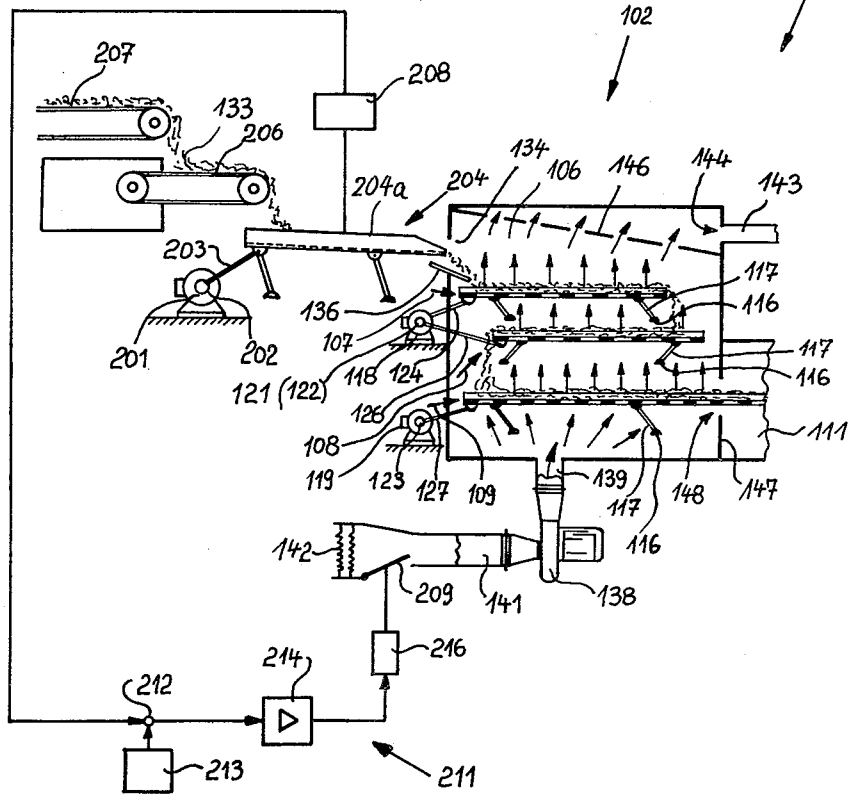
FIG. 3 is a fragmentary schematic partly elevational and partly sectional view of a second conditioning apparatus.

FIG. 3 illustrates a portion of a second conditioning apparatus which differs from the apparatus of FIG. 1 mainly in that the belt conveyor 37 is replaced with a further vibratory conveyor 204 serving to deliver tobacco particles 133 in the form of a continuous stream through the inlet opening 134 and onto the uppermost vibrating conveyor 107 in the chamber 106. All such parts of the second apparatus which are identical with or clearly analogous to corresponding parts of the first apparatus are denoted by similar reference characters plus 100. Furthermore, the conditioning apparatus of FIG. 3 comprises detector means 208 which determines the initial moisture content of tobacco particles 133 prior to entry of such particles into the chamber 106. FIG. 3 merely shows the first section 102 of the transporting system 101, the other two sections being assumed to be identical with the sections 3 and 4 of the system 1 shown in FIG. 1.

The trough 204*a* of the conveyor 204 is vibrated by a connecting rod 203 which receives motion from an eccentric 202 on the output shaft of a variable-speed electric motor 201. The trough 204*a* is preceded by a metering device including a weighing belt conveyor 206 which receives a continuous stream of tobacco particles 133 from a further belt conveyor 207. The weighing conveyor 206 is of known design; it is operated in such a way that it delivers to the trough 204*a* unit quantites of tobacco particles per unit of time. Such weighing conveyors are used in many types of tobacco processing plants to insure constant delivery of tobacco to conveyors, hoppers or the like. Suitable weighing conveyors are produced by the Firm Kukla of Vöcklabruck, Austria, under the designation DWB.

The moisture detector 208 for tobacco in the trough 204*a* is preferably of the same type (HWK) as the moisture detector 99 of FIG. 1. The suction pipe 141 for the blower 138 which delivers hot air into the lower portion of the chamber 106 is provided with a regulating valve 209 similar to the valve 67 of FIG. 1 and having a flap which is pivotable by a servomotor 216. The latter forms part of a control unit 211 which receives signals from the moisture detector 208 and further includes a potentiometer 213 or an analogous source of reference signals, a signal comparing stage 212 and an amplifier 214. The regulating valve 209 can change the ratio of the hot air which has been heated by the heater 142 at the intake end of the suction pipe 141 to unheated atmospheric air which is admitted by the valve 209 to thus change the temperature of air which is caused to flow into the chamber 106.

The operation of the conditioning apparatus which includes the structure of FIG. 3 is as follows:

The belt conveyor 207 delivers a continuous stream of tobacco particles 133 onto the conveyor 206 which weighs successive increments of tobacco and delivers tobacco at a constant rate into the trough 204*a*. This insures that the rate of delivery of tobacco particles onto the uppermost vibratory conveyor 107 in the chamber 106 is constant. Such particles reach the foraminous bottom wall of the conveyor 107 by way of the chute 136 and thereupon descend onto the conveyors 108, 109 to be transported into, through and beyond the intermediate and rear sections of the transporting system 101 in the same way as described in connection with FIG. 1.

The detector 208 ascertains the moisture content of tobacco in the trough 204*a* and generates signals which are transmitted to the stage 212. The latter also receives a reference signal from the potentiometer 213; such signal indicates the desired or normal initial moisture content of tobacco particles 133. The stage 212 transmits to the amplifier 214 a signal when the signal form the detector 208 differs from the signal furnished by the potentiometer 213, and the amplifier 214 then causes the servomotor 216 to adjust the valve 209 to effect a more or less intensive heating action in the chamber 106. The purpose of the control unit 211 is to compensate for fluctuations of the initial moisture content of tobacco particles 133 which are fed into the chamber 106 of the first transporting section 102 by altering the condition of hot air in the pipe 139 in dependency on the condition of incoming tobacco. This insures that the condition (particularly the moisture content) of tobacco which enters the chamber 111 of the intermediate transporting section does not deviate appreciably from a predetermined condition which is best suited to insure that tobacco which leaves the transporting system 101 is maintained at a predetermined temperature and has a predetermined moisture content.

Figure 4:
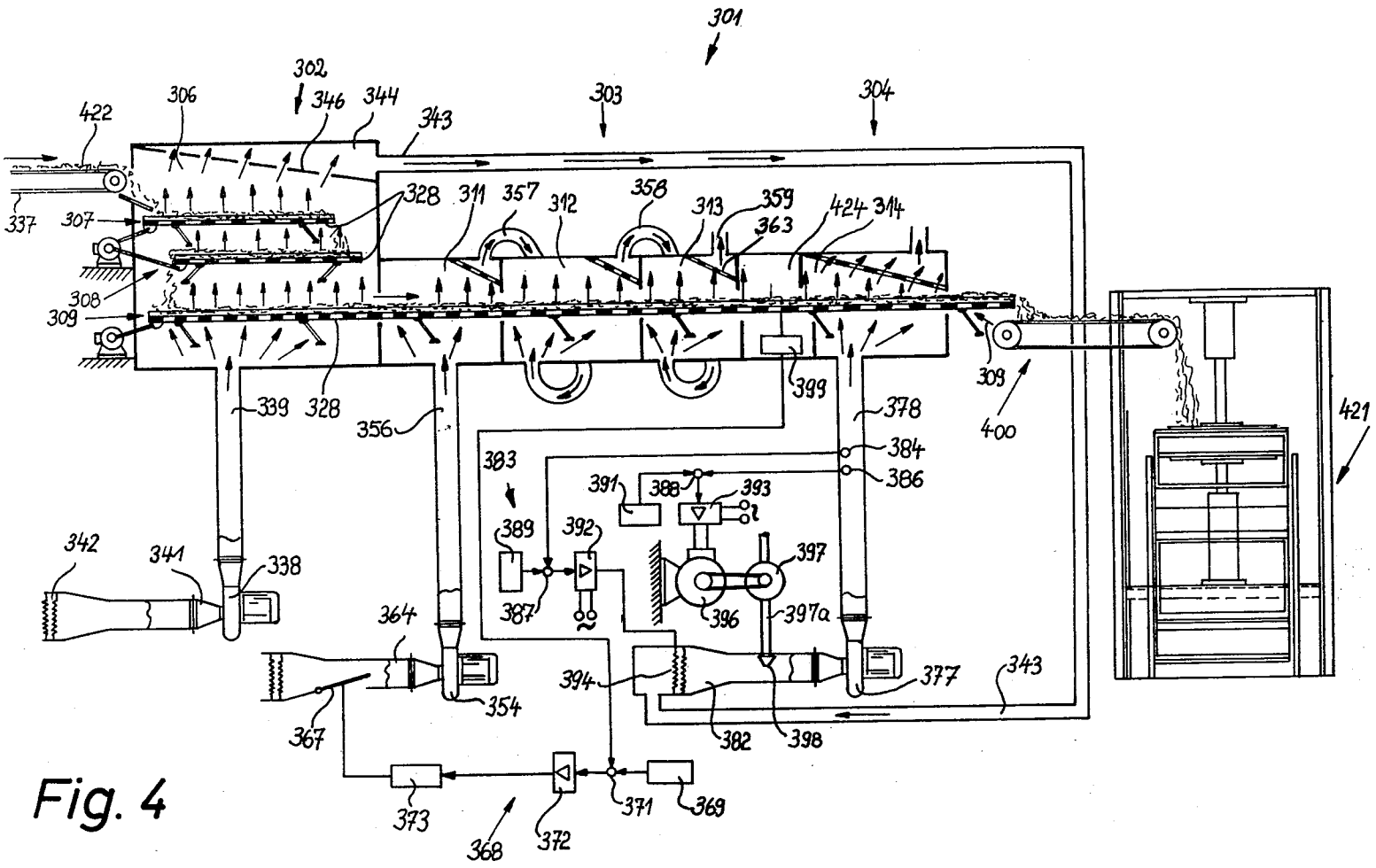
FIG. 4 is a schematic partly elevational and partly sectional view of a third conditioning apparatus which is particularly suited for primary treatment of greenleaf tobacco.

FIG. 4 illustrates a conditioning apparaus for so-called greenleaf tobacco 422. Such tobacco is supplied in the form of a stream on the upper stretch of a belt conveyor 337 to enter the uppermost vibratory conveyor 307 in a chamber 306 forming part of the first section 302 of a transporting system 301. The conveyor 307 delivers tobacco 422 onto a second vibratory conveyor 308 which, in turn, delivers tobacco onto a longer third vibratory conveyor 309 extending through and beyond the sections 302, 303, 304 of the transporting system 301. The section 303 has three chambers 311, 312, 313 and the section 304 has a single chamber 314.

The means for delivering a continuous current of hot air into the lower portion of the chamber 306 is similar to the corresponding means of FIG. 1; it also comprises a blower 338, a suction pipe 341, a heater 342 and a further pipe 339. The construction of all three vibratory conveyors 307, 308, 309 is preferably identical with that of the conveyor 7 shown in FIG. 2. As the bottom walls 328 of the conveyors 307–309 break up the ascending air current in the chamber 306 into smaller air currents which pass through the perforations of the respective bottom walls, such small air currents assist the bouncing action of the bottom walls 328 to insure that the tobacco particles 422 which advance in the vibratory conveyors form layers of agitated particles all sides of each of which are subjected to the action of hot air to insure a uniform drying and moisture-expelling action. This guarantees an optimum exchange of energy between greenleaf tobacco 422 and hot air as well as gentle treatment of tobacco without excessive breakage or comminution and without appreciable formation of dust. Since the side walls (not specifically shown) of the conveyors 307–309 diverge in the same way as the side walls 31, 32 shown in FIG. 2, the speed of air currents which pass though the perforations of the bottom walls 328 decreases to thus reduce the likelihood that the lighter tobacco leaves would tend to rise with the air currents toward the screen 346 below the outlet opening 344 which is the intake end of the conduit 343. The latter receives air whose temperature is lower than that of air in the pipe 339 but which has a higher moisture content.

The thus treated tobacco 422 thereupon passes through the chambers 311, 312, 313 of the transporting section 303 and is treated by hot air which is delivered into the chamber 311 by a blower 354 through a pipe 356. The suction pipe 364 of the blower 354 contains a regulating valve 367 whose flap can be pivoted by a servomotor 373 forming part of a control unit 368 which is practically identical with the control unit 68 except that the moisture detector 399 is mounted in an auxiliary chamber 424 located between the chambers 313 and 314. The manner in which the chambers 311–313 are connected with each other (by way of conduits 357, 358) is preferably the same as described in connection with FIG. 1. Spent hot air passes through a sieve 363 in the chamber 313 and is discharged into the atmosphere by way of an outlet opening 359.

The lower portion of the chamber 314 receives the hot air which is supplied by a blower 377 through a pipe 378 containing a pair of detectors 384, 386 corresponding to the similarly referenced detectors 84, 86 of FIG. 1. The temperature and/or moisture content of air in the chamber 314 preferably corresponds to the desired temperature and/or moisture content of conditioned greenleaf tobacco 422 which is delivered to a take-off conveyor 400. The suction pipe 382 of the blower 377 contains a heater 394 which is adjustable in the same way as described in connection with the heater 94 of FIG. 1. Therefore, the parts of the control unit 383 are denoted by reference characters similar to those employed in FIG. 1 plus 300. The moisture content of air in the pipe 378 can be varied by the motor 396 which drives the pump 397 in a water line **397*a* the lower end portion of which extends into the suction pipe 382 and is provided with an atomizing nozzle 398**.

The conveyor 400 delivers conditioned greenleaf tobacco 422 into a compacting device here shown as a baling press 421 of known design wherein the tobacco is compacted to form bales which are ready for storage. A baling press which can be used in the conditioning appratus of FIG. 4 is produced by the Firm Heinen of Varel, Federal Republic Germany.

The provision of auxiliary chamber 424 and the placing of the moisture detector 399 into such auxiliary chamber insure that the condition of tobacco 422 entering the chamber 314 of the last transporting section 304 can be regulated with an extremely high degree of accuracy. This, in turn, insures that the condition of tobacco 422 leaving the chamber 414 will be maintained within a very narrow range. The signals whih are generated by the detector 399 (such signals indicate the moisture content of tobacco in the chamber 424) are transmitted to the stage 371 of the control unit 368 so that the position of the valve 367 can be changed in dependency on changes in the moisture content of tobacco in the chamber 424. Consequently, the conditioning of air which flows through the chambers 311–313 of the transporting section 303 can be selected with a view to insure that the moisture content of tobacco 422 in the auxiliary chamber 424 equals the moisture content represented by the reference signal from the potentiometer 369 or that, if the moisture content which is detected by the device 399 in the chamber 424 deviates from such desirable moisture content, the condition of tobacco particles 422 can be rapidly changed before the particles enter the final conditioning chamber 314. Therefore, air which is supplied by the blower 377 must compensate only for minor deviations of the moisture content of tobacco from the desired final moisture content as selected by the potentiometer 391.

It is clear that the auxiliary chamber 424 can be used with equal advantage in the conditioning apparatus of FIG. 1 or 3, i.e., that the final measurement of moisture content of tobacco need not take place downstream of the transporting system but can be carried out during transport of tobacco between the last two sections of the transporting system. This holds true for the conditioning of greenleaf tobacco as well as for the conditioning of other types of tobacco. The actual drying of tobacco particles takes place in the first two sections, and the actual or final conditioning takes place in the rear section of the transporting system.

An important advantage of the apparatus of FIGS. 1–2, 3 and 4 is that the particles of tobacco are subjected to a gentle initial drying action (in the chamber 6, 106 or 306) because such treatment takes place by resorting to a current of hot air which flows countercurrent to the direction of tobacco transport. The initial drying is followed by a treatment with hot air which flows concurrent with the direction of tobacco transport (in the section 3, 103 or 303), and finally by establishment of a hygroscopic equilibrium between hot air and tobacco (in the section 4, 104 or 304). The last treatment (in the section 4, 104 or 304) insures that the moisture content is the same in each portion of each tobacco particle.

Another important advantage of the improved method and apparatus is that the transport of tobacco and the conditioning of air which is admitted into the three sections of the transporting system can be regulated in a simple way and with a high degree of accuracy. This is important in connection with the treatment of certain types of tobacco since it is often necessary to maintain the moisture content of tobacco within a very narrow range of a small fraction of one percent. A further advantage of the improved method and apparatus is that the particles of tobacco are treated gently (due to the provision of vibratory conveyors which insure the formation of a layer of agitated tobacco particles) and that the treatment results in uniform drying of all portions of each tobacco particle as well as in minimal breakage or comminution and negligible formation of tobacco dust.

Figure 5:
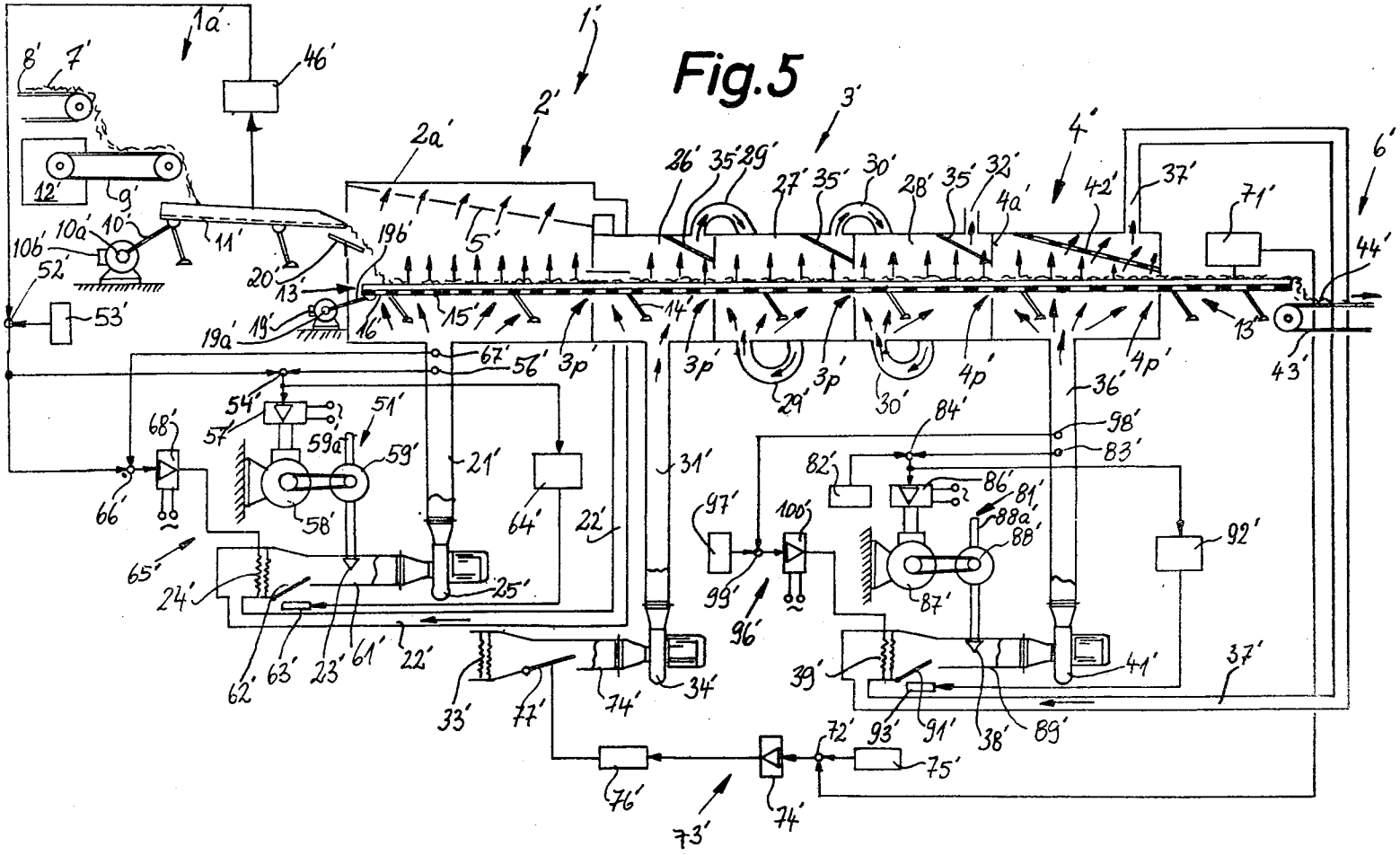
FIG. 5 is a schematic partly elevational and partly sectional view of a fourth conditioning apparatus wherein the particles of tobacco are subjected to a homogenizing action prior and subsequent to expulsion of surplus moisture.

The conditioning apparatus of FIG. 5 comprises a tobacco feeding unit **1*a*′ and a transporting system 1′ including a first homogenizing section 2′ located immediately downstram of the feeding unit 1*a*′, a drying section 3′ located immediately downstream of the section 2′, and a second homogenizing section 4′ located immediately downstream of the section 3′. The section 4′ is followed by a removing unit 6′ which accepts conditioned tobacco from the system 1′**.

The feeding unit **1*a*′ comprises a set of three conveyors for a continuous stream of tobacco particles 7′. These conveyors include a first belt conveyor 8′** whose discharge end showers successive increments of the tobacco stream onto the upper stretch of a second belt conveyor 9', and a vibratory conveyor 11' having a trough which receives successive increments of the tobacco stream from the discharge end of the belt conveyor 9'. The trough of the conveyor 11' is vibrated by the eccentric 10a' of an electric motor 10b' through the medium of a connecting rod 10'. The conveyor 9' forms part of a weighing device 12' of the aforedescribed character which serves to insure that the trough of the vibratory conveyor 11' receives tobacco particles 7' at a uniform or unchanging rate per unit of time.

The conveyor 11' discharges tobacco particles 7' onto a downwardly inclined chute 20' which is installed in an opening provided in the left-hand side wall of a chamber 2a' forming part of the section 2'.

Figure 6:
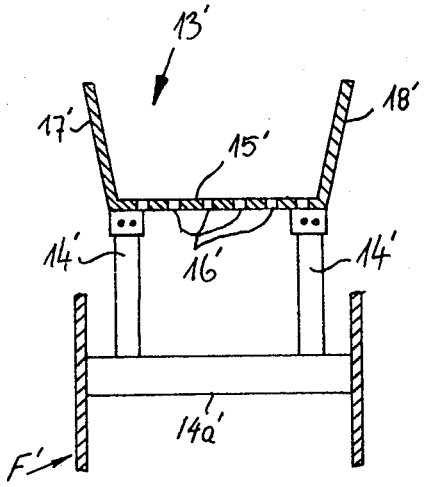
FIG. 6 is an enlarged transverse vertical sectional view of a conveyor in the apparatus of FIG. 5.

The chamber 2a' of the section 2' of the transporting system 1' receives the leftmost part of an elongated vibratory conveyor 13' a portion of which is illustrated in FIG. 6. The trough of the conveyor 13' comprises a foraminous bottom wall or platform 15' having perforations or holes 16' and being supported by leaf springs 14' mounted on a carrier 14a' in the frame F'. The trough of the conveyor 13' further comprises two side walls 17', 18' which diverge upwardly and outwardly in the same way and for the same purpose as described in connection with the side walls 31, 32 of FIG. 2, i.e., to reduce the speed of air currents which flow upwardly through the holes 16' of the bottom wall 15' and to prevent such currents from entraining lighter tobacco particles 7'. The vibratory conveyor 13' is substantially horizontal and extends through all three sections 2'–4' of the transporting system 1' as well as beyond the section 4' to deliver conditioned tobacco to the removing unit 6'. The means for vibrating the trough of the conveyor 13' comprises a variable-speed electric motor 19' having an eccentric 19a' which transmits motion to the trough by way of a connecting rod 19b'.

It is clear that the one-piece vibratory conveyor 13' of FIGS. 5 and 6 can be replaced by a series of discrete conveyors, for example, by three conveyors, one for each of the sections 2', 3' and 4'. At least one of the three conveyors need not be a vibratory conveyor.

The means for contacting tobacco in the section 2' with a gaseous homogenizing medium comprises a pipe 21' which communicates with the chamber 2a' at a level below the bottom wall 15' of the vibratory conveyor 13'. Spent gaseous fluid (preferably air) is withdrawn from the chamber 2a' at a level above the layer of tobacco particles 7' in the trough of the conveyor 13' by a pipe or conduit 22'. A sieve or filter 5' is provided in the chamber 2a' to prevent the homogenizing fluid from entraining lighter tobacco particles into the inlet of the conduit 22'.

The discharge end of the conduit 22' is connected with the inlet of the pipe 21' by an air conditioning unit having an atomizing nozzle 23' for discharging controlled quantities of water into the air current supplied by the conduit 22', and an adjustable electric resistance heater 24'. The means for circulating air through the chamber 2a' comprises a blower 25' which draws air from the conduit 22' and forces the thus withdrawn air into the pipe 21'. The nozzle 23' and the heater 24' are installed in a suction pipe 61' which receives air from the conduit 22' and supplies air to the inlet of the blower 25'. Air which enters the suction pipe 61' is heated by the heater 24' and thereupon receives moisture from the nozzle 23'.

The second section 3' of the transporting system 1' comprises three chambers 26', 27', 28' which are separated from each other by transverse partitions having openings 3p' for the adjacent portions of the vibratory conveyor 13' and for the layer of tobacco particles 7' on the bottom wall 15'. The upper portion of the chamber 26' (above the conveyor 13') communicates with the lower portion of the chamber 27' (below the conveyor 13') by way of a suitably configurated conduit or pipe 29'. The upper portion of the chamber 27' communicates with the lower portion of the chamber 28' by way of a similar conduit or pipe 30'. The upper portion of the chamber 28' has an outlet opening 32' which discharges air into the atmosphere. A first sieve 35' in the upper portion of the chamber 26' prevents lighter particles of tobacco from entering the inlet of the conduit 29'. Similar sieves or filters 35' are provided in the upper portion of the chambers 27' and 28' to respectively prevent lighter tobacco particles from entering the conduit 30' and outlet opening 32'.

The blower portion of the chamber 26' receives heated air by way of a pipe 31' which is connected to the outlet of a blower 34'. The intake of the blower 34' is connected with a suction pipe 74' having an open end for admission of atmospheric air and an adjustable regulating valve or flap 77' which can be pivoted by a servomotor 76'. Atmospheric air which enters the inlet of the suction pipe 74' is heated by a preferably adjustable electric resistance heater 33', and the temperature of heated air entering the blower 34' can be regulated by changing the angular position of the flap 77' which thereby admits a controlled quantity of unheated atmospheric air into the current of air which has passed the heater 33'.

The third section 4' of the transporting system 1' comprises a chamber 4a' having side walls which are provided with openings 4p' for the vibratory conveyor 13'. The lower portion of the chambers 4a' (below the conveyor 13') receives a homogenizing fluid (preferably air) by way of a pipe 36' which receives air from a blower 41'. The intake of the blower 41' is connected with a suction pipe 89' which receives air from an elongated conduit or pipe 37' communicating with the upper portion of the chamber 4a'. A sieve or filter 42' in the upper portion of the chamber 4a' prevents lighter tobacco particles from entering the inlet of the conduit 37'. The suction pipe 89' contains an adjustable electric resistance heater 39' and the air current flowing therein can receive controlled quantities of atomized water through the orifices of a nozzle 38'.

The removing unit 6' comprises a take-off conveyor 43' here shown as an endless belt the upper stretch of which receives conditioned tobacco particles 44' from the discharge end of the vibratory conveyor 13'. The belt 43' transports conditioned tobacco to a further processing station, e.g., to a baling machine or to the magazine of a cigarette rod making machine, depending on the nature of tobacco particles 7' which are supplied by the feeding unit 1a'.

The moisture content of successive increments of tobacco in the trough of the vibratory conveyor 11' is ascertained by a detector 46', e.g., a detector known as HWK produced by the assignee of the present application. The signals which are generated by the detector 46' are transmitted to a signal comparing stage 52' forming part of a control unit 51' which constitutes a means for regulating the moisture content of the current of air flowing into the lower portion of the chamber 2a'. The stage 52' is further connected with a potentiometer 53' or another suitable source of reference signals which is adjustable to furnish reference signals indicating the desired or optimum initial moisture content of tobacco particles 7' in the conveyor 11'. The output of the stage 52' transmits a positive or negative signal when the intensity of signals generated by the detector 46' deviates from the intensity of the reference signal supplied by the potentiometer 53'.

The signal from the output of the stage 52' is transmitted to a second signal comparing stage 54' of the control unit 51' as well as to one input of a signal comparing stage 66' forming part of a second control unit 65' which regulates the heater 24' in the suction pipe 61' of the blower 25'. The stage 54' of the control unit 51' further receives signals from a detector 56' which is mounted in the pipe 21' and monitors the moisture content of the air current flowing into the lower portion of the chamber 2a'. The detector 56' may constitute a conventional hydrometer. The signal from the output of the stage 54' is indicative of the difference between the intensities of signals furnished by the stage 52' and detector 56', and is amplified by an amplifier 57' which is in circuit with a variable-speed electric motor 58' for a variable-delivery pump 59' which supplies water to the atomizing nozzle 23' in the suction pipe 61'. The pump 59' draws water from a reservoir (now shown) via conduit 59a'.

The suction pipe 61' is further provided with an adjustable regulating valve or flap 62' which is located downstream of the heater 24' and upstream of the nozzle 23' (as considered in the direction of air flow from the conduit 22' into the blower 25') and whose position is adjustable by a servomotor 63'. The signals for adjustment of the flap 62' via servomotor 63' are supplied by the output of a threshold circuit 64' which receives signals from the stage 54' of the control unit 51'.

The potentiometer 53' of the control unit 51' is preferably adjusted in such a way that the current of air flowing into the lower portion of the chamber 2a' is in a state of hygroscopic equilibrium with tobacco particles 7' which are supplied by the chute 20' onto the leftmost part of the vibratory conveyor 13'. Thus, at least the major part of tobacco which is caused to travel through the chamber 2a' does not accept moisture from and is not relieved of moisture by the current of air which is supplied by the pipe 21'. The definition "hygroscopic equilibrium" need not necessarily indicate that the moisture content of tobacco in the chamber 2a' is identical with or even close to the moisture content of air issuing from the pipe 21'. In fact, in most instances, the moisture content of air which is in a state of hygroscopic equilibrium with tobacco deviates considerably from (it is must higher than) the moisture content of tobacco. The difference between the moisture content of tobacco and the moisture content of air which is in a state of hygroscopic equilibrium with tobacco depends on a number of factors, especially the condition of tobacco (e.g., the nature and percentage of fluid and/or other matter which is confined in tobacco particles and the chemical composition of such other matter of fluid), the structure of tobacco (e.g., the formation of capillaries in the tissue of tabacco particles), and the brand of tobacco. For example, the composition of casing and/or the nature and percentage of salts in tobacco will influence that moisture content of air or another gas at which the gas is in a stage of hygroscopic equilibrium with tobacco.

The signal which is transmitted from the stage 52' of the control unit 51' to the stage 66' of the control unit 65' is amplified by an amplifier 68' which controls the heater 24' in the suction pipe 61' of the blower 25'. The stage 66' further receives signals from a detector 67' which is installed in the pipe 21' and monitors the temperature of air flowing into the lower portion of the chamber 2a'. The detector 67' may constitute a commercially available heat-sensitive PTC or NTC semiconductor.

A further detector 71' (which may be identical with or similar to the detector 46') is adjacent to the path of conditioned tobacco particles 44' in the vibratory conveyor 13' immediately upstream of the take-off conveyor 43'. The detector 71' monitors the final moisture content of tobacco and transmits appropriate signals to a first input of a signal comparing stage 72' forming part of a control unit 73' for regulating the temperature of air entering the blower 34'. A second input of the stage 72' is connected with the output of an adjustable source 75' of reference signals (e.g., a potentiometer) which transmits a reference signal indicating the desired temperature of air which flows into the lower portion of the chamber 26'. The output of the stage 72' is connected with an amplifier 74' which transmits amplified signals to the servomotor 76' for the adjustable flap 77' in the suction pipe 74'.

The characteristics of air which is admitted into the lower portion of the chamber 4a' are determined by two control units 81' and 96'. The control unit 81' determines the exact moisture content of inflowing air, and the control unit 96' determines the exact temperature of such air. The difference between the control units 81' and 96' on the one hand and the control units 51' and 65' on the other hand is that the control units 81' and 96' are adjusted in insure that the final moisture content of tobacco particles (44') does not deviate from a desired or optimum value.

The control unit 81' comprises an adjustable source 82' of reference signals (e.g., a potentiometer) which transmits reference signals to one input of a signal comparing stage 84'. Another input of the stage 84' receives signals from a detector 83' which monitors the moisture content of air flowing in the pipe 36'. The signal at the output of the stage 84' is amplified by an amplifier 86' which is in circuit with a variable-speed electric motor 87' for a variable-delivery pump 88'. The latter supplies controlled quantities of water to the nozzle 38' in the suction pipe 89' of the blower 41' and is connected with a source of water by a conduit 88a'. The suction pipe 89' is provided with an adjustable regulating valve or flap 91' which is mounted between the heater 39' and nozzle 38' and is pivotable by a servomotor 93' receiving signals from a threshold circuit 92' which is connected to the output of the stage 84'.

The control unit 96' comprises an adjustable source 97' of reference signals (e.g., a potentiometer) which transmits reference signals of selected intensity to one input of a signal comparing stage 99'. Another input of the stage 99' is connected with a detector 98' which monitors the temperature of air in the pipe 36'. The signal from the output of the stage 99' is amplified by an amplifier 100' and regulates the heater 39' in the suction pipe 89'.

The operation of the conditioning apparatus of FIG. 5 is as follows:

The moisture content of tobacco particles 7' exceeds the desired moisture content of tobacco on the take-off conveyor 43'. The particles are delivered by the belt conveyor 8' in the form of a continuous stream which is equalized by the weighing device 12' and fed into the trough of the vibratory conveyor 11'. Thus, the conveyor 11' receives and discharges identical or nearly identical quantities of moist tobacco per unit of time. The detector 46' monitors the initial moisture content of tobacco particles 7' and transmits signals to the stage 52' of the control unit 51'. The detector 46' is a transducer which furnishes to the stage 52' electric signals of varying intensity.

The conveyor 11' discharges tobacco particles 7' into or onto the chute 20' which supplies such particles into the leftmost part of the trough forming part of the vibratory conveyor 13', i.e., into the chamber 2a' of the first homogenizing section 2'. The holes 16' in the bottom wall 15' of the conveyor 13' permit the passage of small currents of conditioned air which is supplied by the pipe 21'. Such currents cause the particles 7' of the stream on the bottom wall 15' to rise and to float within the confines of divergent side walls 17', 18'. This insures highly satisfactory conditioning of all sides of each tobacco particle 7'.

An important function of the first homogenizing section 2' is to insure a pronounced and reliable homogenization of tobacco which is supplied by the feeding unit 1a'. Thus, the section 2' eliminates eventual differences in the moisture content of tobacco entering the chamber 2a' in response to signals generated by the detector 46'. This insures that the drying action of air in the chambers 26', 27', 28' of the section 3' is highly satisfactory since the moisture content and temperature of tobacco particles 7' entering the chamber 26' are constant due to the homogenizing action of air currents passing through the holes 16' of the bottom wall 15' in the chamber 2a'.

The control unit 51' insures that the moisture content of air entering the pipe 21' changes as soon as the intensity of signals furnished by the detector 56' in the pipe 21' deviates from the intensity of signals furnished by the stage 52'. The control unit 65' insures that the heater 24' is adjusted (to effect a more or less pronounced heating of air which is supplied by the conduit 22') when the intensity of signals furnished by the detector 67' deviates from the intensity of signal supplied by the stage 52' (to junction 66'). Thus, not only the moisture content but also the temperature of air which flows in the pipe 21' is a function of the initial moisture content of tobacco particles 7'. As mentioned above, the moisture content of air in the pipe 21' is selected with a view to insure that the air is in a state of hygroscopic equilibrium with tobacco in the chamber 2a', i.e., air which enters and passes through the chamber 2a' should not remove moisture from or add moisture to tobacco which passes through the section 2' toward the chamber 26'. Changes of the moisture content of tobacco passing through the section 2' are not necessary since the main (and preferably the sole) purpose of air which is supplied by the blower 25' is to homogenize the tobacco before the particles 7' reach the drying section 3'. The homogenizing action of air in the chamber 2a' is regulated for the purpose of insuring that the moisture content of all particles 7' leaving the section 2' is identical with the moisture content of the bulk of tobacco particles supplied by the feeding unit 1a'. Such homogenizing action of the current of air which is circulated along the endless path defined by the pipe 21', chamber 2a', conduit 22', suction pipe 61' and blower 25' is very reliable whereby the characteristics of this current change vary little since the air is not supposed to supply moisture to or remove moisture from tobacco particles 7'. Eventual fluctuations of moisture content of the just described air current are eliminated by the control unit 51' which regulates the admission of moisture via nozzle 23'. If the air flowing in the pipe 21' is so moist that its moisture content exceeds the desired value even if the admission of atomized water through the nozzle 23' is terminated, the signal from the output of the stage 54' causes the threshold circuit 64' to actuate the servomotor 63' which opens the flap 62' to admit atmospheric air into the suction pipe 61' and to thereby reduce the moisture content of air which flows into the lower portion of the chamber 2a'. Such reduction of the moisture content of air in the pipe 21' takes place practically without delay.

The particles 7' of tobacco in the trough of the vibratory conveyor 13' form a floating stream which advances through the first opening 3p' and enters the first chamber 26' of the section 3'. Such particles are contacted, from all sides, by hot air which is admitted by the pipe 31' to thus insure a pronounced exchange of energy and rapid drying of tobacco. The temperature of hot air entering the lower portion of the chamber 26' is regulated by the control unit 73' in response to signals which are furnished by the detector 71'. The drying is continued in the chambers 27' and 28' so that the moisture content of tobacco leaving the chamber 28' via first opening 4p' is normally reduced to a desired optimum value for further processing. The dimensions of the section 3' are relatively small which is desirable in a modern tobacco processing plant.

In order to insure a still more satisfactory homogenization or uniformizing of all characteristics of tobacco particles which leave the section 3', the conditioning apparatus includes the second homogenizing section 4' which is especially desirable when the section 3' is very short and compact, i.e., when the intensive drying of tobacco particles takes place within a very short interval of time. The current of air which is circulated by the blower 41' has a constant temperature and moisture content (see the control units 96' and 81') and is in a state of hygroscopic equilibrium with tobacco in the chamber 4a'. Thus, the function of air in the chamber 4a' is analogous to that of air in the chamber 2a'.

The signal from the output of the stage 84' causes the threshold circuit 92' to actuate the servomotor 93' and to open the flap 91' in order to admit atmospheric air into the suction pipe 89' when the moisture content of air in the pipe 36' is excessive while the admission of water via nozzle 38' is interrupted. This results in practically instantaneous reduction of moisture content of air which enters the lower portion of the chamber 4a'.

The apparatus of FIGS. 5 and 6 exhibits the advantage that the interval which is required for the drying of tobacco (in the section 3') can be reduced still further without adversely affecting the desirable characteristics of the particles 44' which issue from the section 4'. This is attributed to homogenization in the sections 2' and 4', i.e., prior to and after drying in the chambers 26', 27' and 28'. Relatively short and compact drying means are desirable for a number of reasons.

Another advantage of the apparatus of FIG. 5 is that at least a portion of at least one of the homogenizing gas currents which contact tobacco particles in the chambers 2a' and 4a' is circulated along an endless path which intersects the path of tobacco particles in the respective portion of the vibratory conveyor 13'. This insures that the characteristics of the circulating gas current or currents must be altered very little or not at all with attendant savings in space and energy requirements of the apparatus. Thus, the control units 51', 65' and 81', 96' are used to change the respective characteristics of the gas currents in the pipes 21' and 36' only when such characteristics deviate from an optimum or given value. The deviations would be much more pronounced if each of the pipes 31', 36' would have to draw atmospheric air which would have to be conditioned prior to entry into the lower portion of the respective chamber 2a', 4a'. These control units are called upon to regulate the respective characteristics of gas currents in the pipes 21' and 36' only when the moisture content of incoming tobacco (conveyor 11' and chute 20') is not uniform and/or when the moisture content of tobacco leaving the chamber 28' is not uniform. Therefore, the control unit 51', 65', 81' and/or 96' normally effects only minor changes of the respective characteristic of the corresponding gas current so that, and referring to the regulation of temperature by the flap 62' or 91', a minor change of the position of such flap suffices to rapidly change the temperature of the gas current in the pipe 21' or 36' to a desired value.

The conveyor 13' also contributes to a more intensive and reliable homogenizing and drying of tobacco particles by causing the particles to vibrate during transport through successive chambers so that the currents of air which are admitted via pipes 21', 31' and 36' can contact all sides of each particle in the respective section of the transporting system. This insures an intensive exchange of heat energy and/or moisture between tobacco particles and gas currents.

The gas current which enters the lower portion of the chamber 4a' homogenizes the particles of tobacco in the respective portion of the conveyor 13' (when necessary) so that the temperature of particles leaving the section 4' equals the temperature of gas in the chamber 4a', either by heating or by cooling the conveyed fibrous material. At least the major portion of tobacco in the chamber 4a' does not receive additional moisture and is not relieved of moisture so that the gas in the chamber 4a' supplies moisture to or withdraws moisture from a small portion of tobacco but does not change the moisture content of the major portion of material on the conveyor 13'.

The treatment of tobacco in the chamber 2a' does not affect the flexibility of particles 7' so that such particles are not comminuted during transport toward the take-off conveyor 43'. In fact, such treatment (by the current of gas entering the chamber 4a' via pipe 21') enhances the elasticity of tobacco particles while the particles are homogenized prior to entering the first chamber 26' of the section 3'.

Still another advantage of the conditioning apparatus of FIG. 5 is that it can dispense with the vibratory conveyors 7, 8 of FIG. 1 and with the corresponding conveyors of FIG. 3 or 4. This allows for a reduction of the dimensions of the chamber 2a' with attendant savings in space and lesser problems in connection with sealing of the chamber. As regards the homogenizing action prior to actual drying, such homogenizing action is performed by the entire gas current which enters the chamber 2a' via pipe 21', and in part by the gas current which enters the chamber 6, 106 or 306 via pipe 39, 139 or 339. As mentioned above, the gas current in the chamber 6, 106 or 306 reaches or can reach a state of hygroscopic equilibrium with tobacco on the uppermost or median conveyor of the section 2, 102 or 302.

Figure 7A:
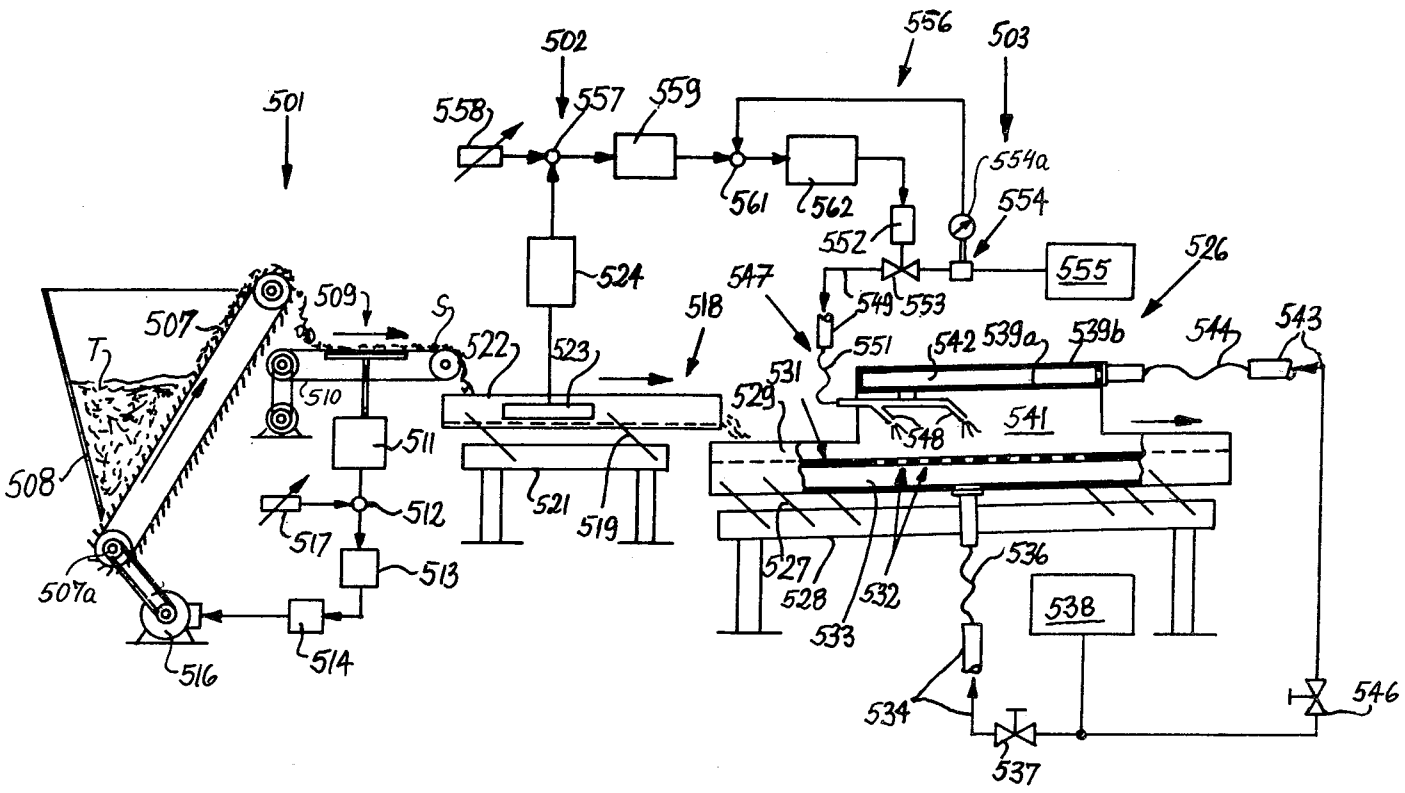
FIG. 7 (composed of FIGS. 7*a* and 7*b*) is a schematic partly elevational and partly sectional view of a conditioning apparatus which constitutes a modification of the apparatus of FIGS. 5 and 6.
Figure 7B:
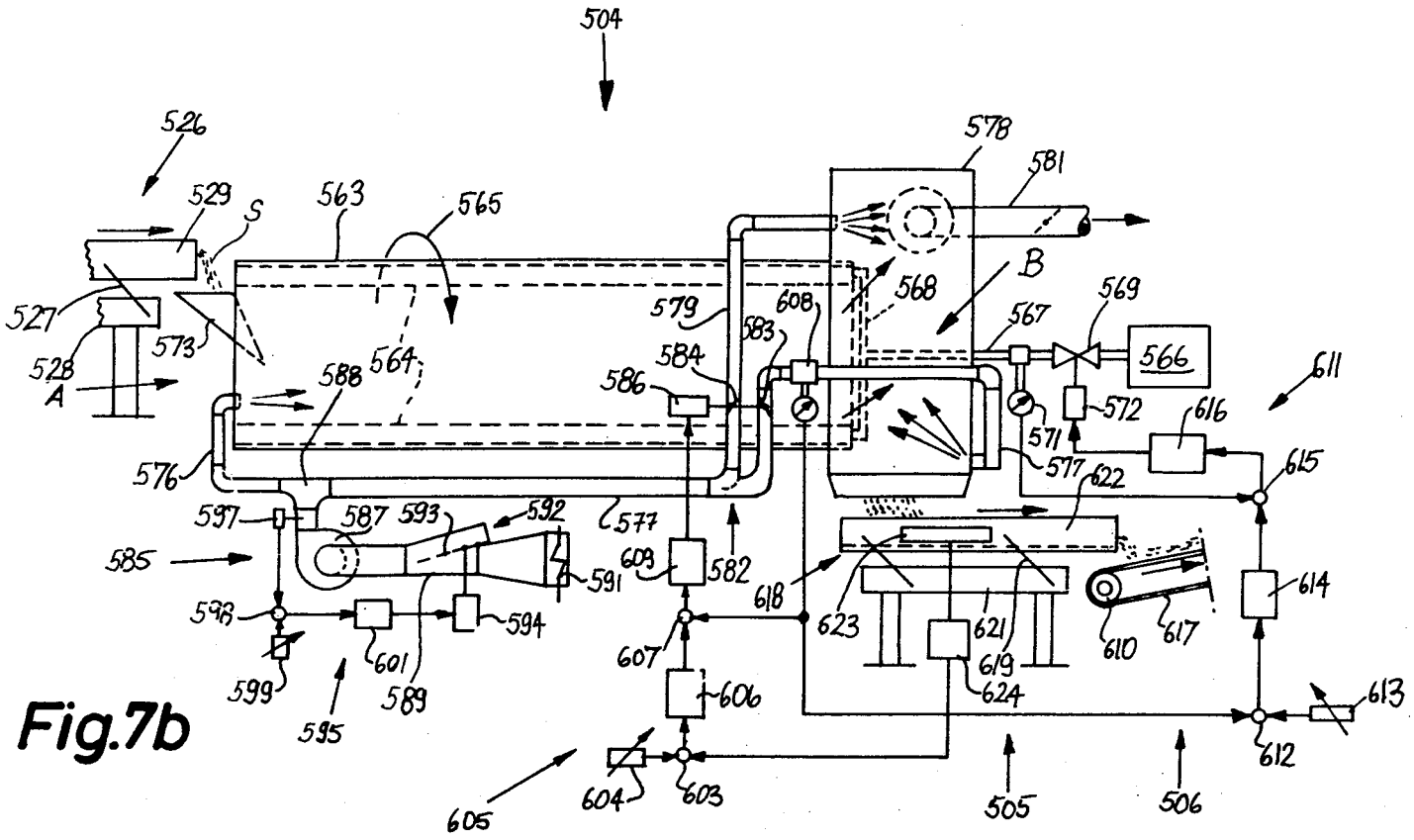

The conditioning apparatus of FIGS. 7a and 7b comprises a transporting unit 501 which delivers a continuous stream S of tobacco particles T to a first moisture monitoring or measuring unit 502 prior to passage of successive increments of the stream through a wetting or moistening unit 503. The stream S which issues from the moistening unit 503 is dried in a drying or moisture reducing unit 504 and thereupon passes through a second moisture monitoring or measuring unit 505 before reaching a removing unit 506. The latter delivers conditioned tobacco to a further processing station, not shown.

The transporting unit 501 draws a continuous stream of tobacco particles T from a source 508 here shown as a magazine or hopper one side wall of which constitutes a component part of the transporting unit 501. This side wall is the left-hand reach of an endless carded belt conveyor 507 which delivers the stream S to the upper reach of an endless belt conveyor 510 forming part of a weighing device 509. The device 509 weighs successive unit lengths of the stream S and transmits signals to the drive means for the conveyor 507 so that the speed of the conveyor 507 is regulated as a function of deviations of measured weight from an optimum value determined by the setting of an adjustable potentiometer 517 constituting a source of reference signals. The weighing device 509 comprises a transducer 511 whose output transmits electric signals denoting the measured weight of successive increments of the stream S. Such signals are transmitted to one input of a signal comparing stage 512 another input of which receives reference signals from the source 517. When the intensity or another characteristic of the signal which is transmitted by the output of the transducer 511 deviates from the corresponding characteristic of the reference signal from 517, the output of the signal comparing stage 512 transmits a signal to the variable-speed prime mover (e.g., a DC-motor) 516 for the lower pulley 507a of the carded belt conveyor 507 by way of a preamplifier 513 and an operational amplifier 514. The just described arrangement insures that the stream S which advances beyond the conveyor 510 of the weighing device 509 is uniform, i.e., each unit length of such stream contains the same quantity of tobacco particles T per weight. In other words, the particles T which advance past the first monitoring unit 502 are transported at a constant rate.

The first moisture monitoring or measuring unit 502 comprises a conveyor 518 including a vibrating trough 522 which receives successive increments of the tobacco stream S from the discharge end of the belt conveyor 510. The trough 522 is mounted on leaf springs 519, which are secured to a frame or support 521, and is agitated by an eccentric in a manner well known from the art (reference may be had to FIG. 1). The moisture detector 524 of the monitoring unit 502 comprises a capacitor whose electrodes 523 are installed in the trough 522. The detector 524 is preferably of the type known as HWK manufactured and marketed by the assignee of the present application.

The moistening unit 503 comprises a tunnel-shaped conveyor 526 which includes a vibrating trough 529 mounted on leaf springs 527 secured to a frame or support 528. The means for agitating the trough 529 is not specifically shown in FIG. 7a; such means may be identical with or similar to that shown in FIG. 1. The trough 529 comprises a foraminous bottom wall 531 which receives successive increments of the stream S from the trough 522 and is formed with apertures 532. The wall 531 constitutes the top wall of an elongated manifold 533 which receives steam from a source 538 by way of a supply conduit 534. The latter comprises a flexible portion or hose 536 and contains an adjustable throttle valve 537 which regulates the rate of admission of steam into the manifold 533 and hence into the apertures 532 of the wall 531.

The left-hand and right-hand end portions of the trough 529 (as viewed in FIG. 7*a*) are open from above so that successive increments of the stream S can descend onto the wall 531 and that successive increments of the moisturized stream can be observed on their way toward the drying unit 504. The trough 529 further includes an upper portion including twin walls 539*a*, 539*b* which define a chamber 542 for reception of steam from the source 538 by way of a supply conduit 543 including a flexible portion or hose 544 and containing an adjustable throttle valve 546. The inner wall 539*a* defines with the wall 531 an elongated channel 541 wherein the tobacco stream S advances toward the drying unit 504. The chamber 542 is sealed from the manifold 533. The particles T of the stream S in the channel 541 are contacted by droplets of atomized liquid (normally water) which is discharged by the spray nozzles 548 of a liquid supplying device 547. The nozzles 548 receive liquid from a source 555 by way of a supply conduit 549 which includes a flexible portion or hose 551 and contains an adjustable valve 553 forming part of a liquid metering device. The metering device further comprises a servomotor (e.g., a DC-motor) 552 which can adjust the rate of liquid flow through the valve 553, and a flow rate measuring device 554 which is installed in the conduit 549 between the source 555 and valve 553. The flow rate measuring device 554 includes a gauge 554*a* and transmits signals (denoting the actual rate of liquid flow through the conduit 549) to a signal comparing stage 561 forming part of a control circuit 556 which adjusts the valve 553 via servomotor 552 in dependency on the measured moisture content of tobacco in the trough 522 of the first monitoring unit 502. The valve 553 may constitute a diaphragm valve of the type 241-1, the servomotor 552 may constitute an electropneumatic regulator of the type 762, and the flow rate measuring device 554 may be of the type 3F, all manufactured and sold by the firm Samson AG, D-6001 Frankfurt/Main 1, Federal Republic Germany.

The output of the moisture detector 524 is connected with a signal comparing stage 557 which is further connected with an adjustable potentiometer 558 or another suitable source of reference signals denoting the desired or anticipated initial moisture content of tobacco particles T forming the stream S. When the actual moisture content (signal from the detector 524) deviates from the desired initial moisture content (reference signal from the source 558), the output of the stage 557 transmits a signal to a regulating circuit 559 which, in turn, transmits the signal to the signal comparing stage 561. The stage 561 further receives signals from the flow rate measuring device 554, and its output transmits a signal to the servomotor 552 via amplifier 562 to change the setting of the valve 553 when the intensity or another characteristic of the signal from 554 deviates from the corresponding characteristic of the signal from 559. This insures that the rate of admission of liquid to successive increments of the tobacco stream S in the channel 541 varies in dependency on fluctuations of the initial moisture content of tobacco, i.e., that the moisture content of tobacco advancing into the drying unit 504 is constant and matches the moisture content which is selected by the setting of the source 558 of reference signals. This establishes optimum conditions for a predictable and reproducible drying action so that the final moisture content of tobacco particles leaving the unit 504 normally matches a preselected (optimum) value.

The streamlets of steam which rise into the channel 541 via apertures 532 in the wall 531 insure a highly desirable separation of tobacco particles which adhere or tend to adhere to each other. Moreover, the streamlets of steam themselves perform a wetting or moisturizing action. It has been found that, as a result of contact with streamlets of steam which enters the channel 541 via apertures 532, the moisture content of tobacco particles in the conveyor 526 can be increased by up to 4 percent. Moreover, hot steam raises the temperature of particles T and thereby enables the droplets of liquid which are sprayed by the nozzles 548 to rapidly penetrate into the particles which advance along the wall 531. This insures that, if and when necessary, particles of tobacco in the channel 541 can absorb large amounts of moisture during travel along a relatively short portion of their path from the magazine 508 toward and in the removing unit 506. The deviations of measured initial moisture content from the predetermined moisture content (as indicated by the reference signal which is transmitted by the source 558) are compensated for by metering the quantity of liquid which is admitted into the nozzles 548.

The drying unit 504 comprises a rotary drum-shaped conveyor 563 which is open at both ends and is rotated in the direction of arrow 565. The inlet A of the conveyor 563 receives successive increments of the stream S from the trough 529 of the conveyor 526 via chute 573. The conveyor 563 is rotated by a motor (not shown) through the medium of gears which mate with one or more ring gears surrounding the conveyor 563. The latter is mounted on rollers which are not specifically shown in the drawing. Reference may be had to commonly owned U.S. Pat. No. 3,372,488 granted Mar. 12, 1968 to Koch et al. which fully describes and shows the manner of mounting and rotating a rotary drum-shaped conveyor in a tobacco conditioning apparatus.

On their way from the inlet A toward the outlet B of the conveyor 563, particles T of the tobacco stream S are contacted and agitated by steam-heated blades or coils 564 which are mounted in and heat the conveyor 563. The fluid (steam) which is caused to flow through the coils 564 to heat the particles T and the conveyor 563 is supplied by a steam generator 566 via conduit 567 which contains an adjustable valve 569 and supplies steam to a distributor 568 at the outlet B. The distributor 568 admits fresh steam to and receives spent steam from the coils 564. Spent steam is returned to the generator 566 via conduit 567 in a manner known from the art of conditioning tobacco. For example, the conduit 567 can include two coaxial tubes which are spacedly telescoped into each other. The inner tube conveys steam from the generator 566 to the coils 564, and the outer tube conveys spent steam back to the generator 566.

The conduit 567 further contains a steam pressure gauge 571 which is installed downstream of the valve 569 and includes a transducer which transmits electric signals denoting the pressure of steam flowing toward and into the coils 564. The means for adjusting the valve 569 includes a DC-motor 572.

The inlet A of the conveyor 563 receives a current of hot gaseous fluid (preferably air) from the discharge end of a fluid admitting pipe 576 which is connected with the outlet of a blower 587. A second fluid admitting pipe 577 admits a current of hot gaseous fluid (air) into the outlet B of the conveyor 563 so that, in contrast to the fluid issuing from the pipe 576, fluid which issues from the pipe 577 flows counter to the direction of advancement of the tobacco stream S in the interior of the conveyor 563. The outlet of the pipe 577 is confined in a vapor withdrawing device 578 which further confines the discharge end of a third fluid admitting pipe 579 serving to supply a current of hot gaseous fluid (air). The discharge end of the pipe 579 is adjacent to the intake of a suction pipe 581 which evacuates vapors from the interior of the withdrawing device 578. The pipe 579 branches off the pipe 577; the junction is shown at 582. This junction is located immediately or closely upstream of two adjustable flow regulating flaps 583, 584 which are respectively installed in the pipes 577, 579 and can be pivoted simultaneously by an adjusting device 586 so that the rate of flow of hot fluid via pipe 577 is increased when the rate of fluid flow via pipe 579 is reduced and vice versa. The adjusting device 586 may constitute or include a reversible DC-motor. The intakes of the pipes 576 and 577 are connected with the outlet of the blower 587 by a tee 588. The blower 587 constitutes one component of a source 585 of heated gaseous fluid which further includes a suction pipe 589 serving to supply heated gaseous fluid to the inlet of the blower. The intake of the pipe 589 is open to the atmosphere and contains a preferably adjustable electric resistance heater 591. The suction pipe 589 has an auxiliary inlet 592 for cool atmospheric air which is mixed with heated atmospheric air (such air is heated by the resistance heater 591) to the extent determined by the setting of an adjustable valve here shown as a flap 593 which is pivotably mounted in the pipe 589 and whose position can be changed by a reversible servomotor (e.g., a DC-motor) 594. The means for selecting the position of the flap 593 to thereby select the temperature of hot gaseous fluid entering the tee 588 and thence the intakes of the pipes 576, 577 comprises a regulating circuit 595 which includes a thermometer 597 monitoring the temperature of fluid in the tee 588 and serving to transmit electric signals denoting the monitored temperature to a signal comparing stage 598. The latter further receives a reference signal from an adjustable potentiometer 599 or an analogous source of reference signals. When the intensity or another characteristic of the signal which is transmitted by the thermometer 597 deviates from the corresponding characteristic of the reference signal (such signal denotes the desired temperature of fluid in tee 588), the output of the stage 598 transmits a signal to an amplifier 601 for the servomotor 594 which then adjusts the flap 593 accordingly. Thus, the pipes 576, 577 and 579 receive hot gaseous fluid whose temperature is constant and corresponds to that which is selected by the setting of the source 599 of reference signals.

The diameters of pipes 576, 577, 579 (and/or the positions of suitable flow regulating valves, not specifically shown, in these pipes) are selected in such a way that approximately one-third of the total amount of hot gaseous fluid flows into the inlet A via pipe 576 and the remainder of such amount flows into the vapor withdrawing device 578, partly via pipe 577 and partly via pipe 579. The flaps 583 and 584 render it possible to regulate the rate of fluid flow via pipes 577 and 579, i.e., toward the inlet of the suction pipe 581 and into the outlet B of the rotary conveyor 563. The total amount of gaseous fluid supplied by the outlet of the blower 587 is collected in and withdrawn from the device 578 via pipe 581. This total amount is selected in such a way that vapors issuing from the device 578 via pipe 581 need not be subjected to any drying action.

The second monitoring or measuring unit 505 which ascertains the (final) moisture content of dried tobacco T downstream of the drying unit 504 is identical with or clearly analogous to the first monitoring unit 502. Therefore, the component parts of the unit 505 are denoted by reference characters similar to those denoting the component parts of the unit 502 plus 100. The detector 624 of the monitoring unit 505 comprises a capacitor whose electrodes 623 are installed in the vibratory trough 622 of a conveyor 618 corresponding to the conveyor 518 of FIG. 7*a*. This detector transmits signals which are used to regulate the rate of fluid flow through the pipe 577 downstream of the junction 582. The signal which is transmitted by the output of the detector 624 denotes the actual moisture content of dried tobacco particles T and is transmitted to a signal comparing stage 603 which compares such signal with a reference signal denoting the desired final moisture content and furnished by an adjustable potentiometer 604 or another suitable source of reference signals. The stage 603 forms part of a conrol circuit 605, and its output transmits signals (when necessary, i.e., when the intensity or another characteristic of the signal at the output of the detector 624 deviates from the corresponding characteristic of the reference signal from 604) to a further signal comparing stage 607 via regulating circuit 606. The stage 607 further receives signals from the transducer of a flow rate measuring device 608 in the pipe 577 downstream of the flap 583, and the output of the stage 607 is connected with the adjusting device 586 for the flaps 583, 584 by way of an amplifier 609.

The signal at the output of the transducer of the flow rate measuring device 608 is further connected with the signal comparing stage 612 of a control circuit 611 for the adjustable valve 569. The circuit 611 regulates the pressure of steam in the coils 564, i.e., the temperature of the conveyor 563 and the direct heating action of coils 564 upon the particles of tobacco T in the conveyor 563. The stage 612 comprises a second input which is connected with an adjustable potentiometer 613 or another suitable source of reference signals denoting the desired or optimum (direct and indirect) heating action of coils 564 upon that portion of the stream S which passes through the conveyor 563. The output of the stage 612 is connected (via regulator 614) with one input of a further signal comparing stage 615 which further receives signals from the transducer of the steam pressure gauge 571. The output of the stage 615 transmits signals to the adjusting means 572 for the valve 569 by way of an amplifier 616.

The removing unit 506 for dried tobacco particles T comprises a continuously driven belt conveyor 617 whose upper reach receives tobacco from the trough 622 of the conveyor 618 and which is trained over pulleys 610 (one shown in FIG. 7*b*). The trough 622 is mounted on a frame or support 621 by leaf springs 619.

The conveyors 510, 518, 526, 573, 563, 618 and 617 can be said to constitute component parts of the transporting unit 501 because they cooperate with the conveyor 507 of the unit 501 to transport the stream S along an elongated path having several portions which are defined by the conveyos 507, 510, 518, 526, 573, 563, 618 and 617. Thus, the conveyor 518 can be said to define a first portion of the aforementioned path, the conveyor 526 can be said to define a second portion of such path, the conveyor 563 can be said to define a third portion of the path, and the conveyor 618 can be said to define a fourth portion of the path.

The operation of the apparatus of FIGS. 7*a* and 7*b* is as follows:

The carded conveyor 507 draws from the magazine 508 a continuous stream S of moist tobacco particles T, and such stream is delivered onto the upper reach of the belt conveyor 510 forming part of the weighing device 509. Successive increments of the weighed tobacco stream S are delivered into the trough 522 of the conveyor 518 in the first moisture monitoring unit 502. The signal at the output of the transducer 511 in the weighing device 509 is transmitted to the stage 512 and is compared with the reference signal from the source 517. When necessary, the output of the stage 512 transmits a signal to the motor 516 via amplifiers 513, 514 to change the speed of the carded conveyor 507 so as to conform the weight of successive unit lengths of the stream S to that which is denoted by the reference signal from the source 517. Regulation of the weight of successive increments of the stream S on their way toward the monitoring unit 502 is desirable and advantageous because this eliminates the effects of fluctuations of the quantity of tobacco upon the drying operation, i.e., the only variable parameter which must be considered in regulating the operation of the moistening unit 503 is the moisture content of the stream S. In other words, the quantity of tobacco which is fed to the conveyor 526 of the monitoring unit 502 per unit of time is constant but the moisture content of such tobacco is likely to fluctuate, and such fluctuations are detected and corresponding signals transmitted by the monitoring unit 502.

Successive increments of the stream S in the vibratory trough 522 of the conveyor 518 advance between the electrodes 523 of the capacitor which forms part of the moisture detector 524. Such increments then advance beyond the trough 522 and enter the conveyor 526 of the wetting unit 503. The electric signal at the output of the detector 524 is transmitted to the corresponding input of the stage 557 and is compared with the reference signal which is furnished by the source 558, such reference signal denoting the anticipated or desired initial moisture content of tobacco particles T which form the stream S. The setting of the source 558 is such that the output of the signal comparing stage 557 transmits a signal only when the moisture content of tobacco particles T between the electrodes 523 is too low, i.e., when the intensity or another characteristic of the reference signal transmitted by the source 558 exceeds the corresponding characteristic of the signal at the output of the detector 524. The stage 557 then transmits a signal of appropriate intensity to the regulating circuit 559 and thence to the corresponding input of the signal comparing stage 561. The signal from the circuit 562 constitutes a reference signal and is compared with the signal which is transmitted by the flow rate measuring device 554 in the control circuit 556. When the rate of liquid flow via conduit 549 deviates from the rate which is denoted by the characteristic of the signal at the output of the regulating circuit 559, the servomotor 552 adjusts the valve 553 to increase or reduce the rate of flow of liquid from the source 555 into the spray nozzles 548.

During travel through the channel 541 of the conveyor 526, successive increments of the stream S are traversed by streamlets or jets of steam issuing from the apertures 532 of the wall 331, i.e., such jets flow transversely across the stream S and the admitted steam agitates the particles T during contact with droplets of atomized liquid which is supplied by the spray nozzles 548. Steam issuing from the apertures 532 insures that the particles T of the stream S are separated from each other and float in a cushion of steam above the wall 331. This guarantees that all sides of all or nearly all particles T are intimately contacted by droplets of atomized liquid as well as by steam. Moreover, the heating action of steam issuing from the apertures 532 promotes the intensity and uniformity of the moistening action in the channel 541. Uniformity of moistening action in the channel 541 is further enhanced by the fact that the conveyor 526 vibrates. This also promotes the penetration of moisture into the particles T which advance toward the chute 573. Therefore, the moisture content of tobacco particles T which advance beyond the channel 541 is surprisingly uniform which is desirable because it facilitates and enhances the drying action in the unit 504.

The trough 529 delivers successive increments of the uniformly moisturized tobacco stream S into the chute 573 and thence into the inlet A of the rotating drum-shaped conveyor 563 where the particles are contacted by hot gaseous fluid issuing from the pipe 577. Such fluid flows concurrent with the direction of transport of tobacco particles T through the conveyor 563. As mentioned above, the quantity of hot gaseous fluid which issues from the pipe 577 is relatively small (approximately one-third of the quantity delivered by the outlet of the blower 587), i.e., the intensity of the initial drying action is not as pronounced as in dryers wherein the entire drying action is effected by a stream of hot gaseous fluid flowing concurrent with the direction of transport of tobacco through the drying zone. At the output B of the conveyor 563, tobacco particles T of the stream S are in a state of hygroscopic equilibrium with the gaseous fluid. The stream S then advances through the vapor removing device 578 and descends into the trough 622 of the conveyor 618 in the second monitoring unit 505 to be delivered onto the upper reach of the belt conveyor 617. During transport by the trough 622, successive increments of the stream S pass between the electrodes 623 of the moisture detector 624 which ascertains the final moisture content of tobacco particles T. The signal which is generated at the output of the detector 624 is transmitted to the stage 603 for comparison with the reference signal from the source 604. If the final moisture content deviates from the desired moisture content (as selected by the setting of the source 604), e.g., if the final moisture content is too high, the output of the stage 603 transmits a signal to the regulating circuit 606 which processes the signal and transmits a signal to the amplifier 609 for the servomotor 586 in order to initiate an adjustment of the flaps 583 and 584. The adjustment (in the event that the final moisture content of tobacco is too high) is such that the rate of flow of hot gaseous fluid in the pipe 577 increases with attendant proportional reduction of the rate of fluid flow via pipe 579. The current of air issuing from the pipe 577 effects a more pronounced drying of successive increments of the tobacco stream S so that, upon completion of adjustment of the flaps 583 and 584, the final moisture content matches the value which is selected by the source 604 of reference signals. The interval of contact between tobacco particles T and the current of hot air issuing from the pipe 577 is relatively short, and the direction of flow of fluid issuing from the pipe 577 is substantially countercurrent to the direction of transport of tobacco particles in the conveyor 563 and vapor removing device 578.

The signals which are processed in the regulating circuit 606 are not transmitted directly to the servomotor 586; such signals are transmitted to the stage 607 which compares them with the signal which is transmitted by the transducer of the flow rate measuring device 608 in the pipe 577 downstream of the flap 583. When necessary, the output of the stage 607 transmits a signal to the servomotor 586 via amplifier 609. The stage 607 ascertains the differences between the actual rate of flow of hot fluid toward the discharge end of the pipe 577 and the desired rate (thus, the signal at the output of the regulating circuit 606 is a reference signal denoting the desired rate of fluid flow toward the discharge end of the pipe 577). Since the final moisture content of tobacco particles T in the trough 622 is assumed to be higher than that which is selected by the setting of the source 604, the flap 583 is adjusted to admit a larger quantity of hot fluid into the discharge end of the pipe 577, i.e., the drying action is intensified and the moisture content of tobacco passing through the conveyor 563 and device 578 is reduced to the desired value. Inversely, the flap 583 is moved to a position in which it reduces the rate of flow of hot fluid into the discharge end of the pipe 577 when the intensity or another characteristic of the signal at the output of the stage 603 is indicative of lower-than-desired final moisture content of tobacco particles T in the trough 622.

The inertia of flaps 583, 584 is low; therefore, the final moisture content of tobacco in the conveyor 563 and device 578 can be changed practically without any delay. However, and since the extent to which the current of hot air issuing from the pipe 577 can regulate the moisture content of tobacco particles T is rather limited, it is desirable to return the flaps 583 and 584 to their normal or neutral positions with a minimum of delay. This also applies for situations when the deviation of the measured final moisture content from the desired final moisture content persists for relatively long intervals of time, i.e., the flaps 583, 584 should reassume their neutral positions even if the detector 624 continues to transmit signals denoting that the measured final moisture content deviates from the optimum value. This is achieved by the provision of the control circuit 611 for regulating the rate of circulation of hot steam in the coils 564 for direct and indirect heating of tobacco particles T in the interior of the drum-shaped conveyor 563. Thus, the coils 564 perform the function of compensating for long-lasting and pronounced deviations of final moisture content from an optimum value. To this end, the signal at the output of the transducer in the flow rate measuring device 608 is transmitted to the signal comparing stage 612 to be compared with the reference signal which is furnished by the source 613. When necessary, the output of the stage 612 transmits a signal to the regulator 614 which is a proportional-integral amplifier (P-I amplifier) of the type described in detail in commonly owned U.S. Pat. No. 3,985,145 granted Oct. 12, 1976 to Broscheit et al. The arrangement is such that, when the intensity (or another characteristic) of the signal which is transmitted to the input of the regulator 614 undergoes an abrupt change, the output of the regulator 614 immediately transmits a corresponding "proportional" signal. In addition, the intensity of the output signal increases with time in accordance with the I-ratio whereby the speed at which the intensity of the output signal increases depends on the extent of abrupt change of intensity of the input signal (i.e., signal from the stage 612). Thus, the output of the regulator 614 immediately transmits a signal (P-ratio) which is a function of the extent of change of intensity of the input signal to immediately initiate a pronounced change in the rate of flow of steam through the coils 564 via signal comparing stage 615, amplifier 616 and adjusting means 572 for the valve 569 in the conduit 567. In other words, the pressure of steam in the coils 564 increases as soon as the intensity of signal at the input of the regulator 614 increases. However, the inertia of heating means including the coils 564 is higher than the inertia of heating means including the pipe 577, i.e., it takes some time to change the temperature of coils 564 and hence the temperature of the conveyor 563 in response to detection of deviation of monitored final moisture content from the desired final moisture conent. As soon as the changed heating of coils 564 takes effect, i.e., as soon as the coils can compensate for deviations of monitored final moisture content from the desired final moisture content, the flaps 583 and 584 reassume their neutral positions so that they are ready to abruptly compensate for eventual future short-lasting deviations of monitored final moisture content from the optimum value. In the absence of any remedial action, return movement of flaps 583, 584 to their neutral positions would result in a change of the final moisture content. This is prevented by the I-component of the regulator 614. As mentioned above, the intensity of output signal which is transmitted by the regulator 614 increases gradually with time at a rate which is a function of the extent of abrupt change of the intensity of signal at the output of the signal comparing stage 612. When the P-ratio of the output signal furnished by the regulator 614 disappears, i.e., when the flaps 583 and 584 return to their neutral positions, the I-ratio of the output signal continues to increase to thus compensate for return movement of flaps 583, 584 to their neutral positions, i.e., for the fact that the heating and drying action of hot gas issuing from the pipe 577 is reduced. Therefore, the means for regulating the rate of flow of steam from the generator 566 into the coils 564 can fully compensate for return movement of flaps 583, 584 to neutral positions because the I-ratio continues to effect the necessary adjustment of the signal at the output of the regulator 614.

It will be noted that the manner in which the particles T are dried in the conveyor 563 is of utmost importance for achievement of a highly satisfactory homogenization of moisture in the particles and also for insuring that the final moisture content of each increment of the stream S which issues from the drum 563 will match the preselected value (as indicated by the reference signal from the source 604). This is achieved by heating the particles T by two hot fluids including the first fluid which issues from the pipes 576, 577 and the second fluid which is circulated in the coils 564. The duration of contact between successive increments of the stream S and the fluid issuing from the pipe 577 is relatively short. The fluid which issues from the pipe 576 is enriched with moisture during flow from the inlet A toward the outlet B of the conveyor 563, and its temperature decreases during flow toward the withdrawing device 578 wherein such fluid merges with the fluids issuing from the pipes 577 and 579. The rate of admission of fluid via pipe 576 as well as the temperature of such fluid is preferably selected in such a way that the fluid is in thermal and hygroscopic equilibrium with tobacco particles at the outlet B of the conveyor 563. In other words, particles T whose moisture content is too low during entry into the conveyor 563 accept moisture from the fluid which is admitted via pipe 576. Inversely, those particles T whose moisture content on entry into the conveyor 563 is excessive are relieved of moisture as a result of contact with fluid which is admitted by the pipe 576. Consequently, the moisture content of all particles T which reach the outlet B of the conveyor 563 is identical or nearly identical. Short-lasting contact between homogeneous portions of the stream S and the fluid which issues from the pipe 577 entails an intensive final drying action whereby the homogeneousness of such portions of the stream S varies very little or not at all.

The temperature and rate of admission of steam via apertures 532 in the wall 531 of the conveyor 526 are preferably selected in such a way that the particles T are heated to an elevated temperature (e.g., approximately 80° C.) prior to entry into the conveyor 563. Therefore, the particles T which are transported through the conveyor 563 can be subjected to a gentle treatment without affecting the quality and reproducibility of the drying action. Thus, the particles T in the drum 563 need not be contacted by large quantities of hot fluid.

Since the moisture content of tobacco particles T which approach the outlet B of the conveyor 563 is already uniform or nearly uniform and normally matches the desired final moisture content, short-lasting contact with abruptly increased or reduced quantities of hot fluid (see the flap 583) which is admitted by the pipe 577 result in rapid reduction of increase of the final moisture content.

The apparatus of FIGS. *7a* and *7b* can be used with particular advantage for conditioning of shredded tobacco. The vapors which are withdrawn by the suction pipe 581 need not be dried because the quantity of hot fluid which is admitted via pipe 579 suffices to reduce the moisture content of vapors to a value at which the pipe 581 can discharge the withdrawn fluid into the atomosphere.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of conditioning tobacco, comprising the steps of transporting a continuous stream of tobacco particles at a constant rate and in a predetermined direction along a predetermined path; measuring the initial moisture content of successive increments of the stream in a first portion of said path; increasing the moisture content of the particles in a second portion of said path downstream of said first portion, as considered in said direction, when the measured initial moisture content is below a predetermined value; and drying the particles of said stream in a third portion of said path downstream of said second portion.

2. The method of claim 1, further comprising the step of heating the particles of tobacco during transport along said second portion of said path.

3. The method of claim 1, further comprising the step of agitating the particles of tobacco in said second portion of said path.

4. The method of claim 1, further comprising the step of conveying a hot fluid transversely across the stream in said second portion of said path.

5. The method of claim 1, further comprising the step of agitating the particles of tobacco in said second and third portions of said path.

6. Apparatus for conditioning tobacco comprising means for transporting a stream of tobacco particles at a constant rate and in a predetermined direction along a predetermined path; monitoring means for measuring the initial moisture content of successive increments of the stream in a first portion of said path; means for moisturizing successive increments of the stream in a second portion of said path downstream of said first portion, as considered in said direction, when the measured initial moisture content is below a predetermined value; and means for drying successive increments of the stream in a third portion of said path downstream of said second portion.

7. The apparatus of claim 6, further comprising means for heating the particles of tobacco in said second portion of said path.

8. The apparatus of claim 6, further comprising means for agitating the particles of tobacco in said second portion of said path.

9. The apparatus of claim 6, further comprising a source of hot gaseous fluid and means for conveying streamlets of hot fluid from said source and transversely across the stream in said second portion of said path.

10. The apparatus of claim 6, wherein said transporting means comprises a substantially tunnel-shaped conveyor which defines said second portion of said path and includes an apertured wall along which successive increments of the stream are transported in said second portion, and further comprising a source of steam and means for connecting said source of steam with said apertured wall so that jets of steam issue from the apertures of said wall and traverse the tobacco stream in said conveyor.

11. The apparatus of claim 10, wherein said conveyor defines a channel for said stream and includes a heated wall bounding at least a portion of said channel to heat the particles of tobacco in said second portion of said path.

12. The apparatus of claim 10, further comprising means for vibrating said conveyor.

* * * * *